United States Patent [19]

Chiles III et al.

[11] Patent Number: 4,887,813

[45] Date of Patent: Dec. 19, 1989

[54] BOWLING SCORING DISPLAY SYSTEM

[75] Inventors: Robert E. Chiles III, Sterling; Bruce R. Neville, Centreville, both of Va.; Richard D. Wattis, Potomac, Md.; Scott Werthmann, Cos Cob, Conn.

[73] Assignee: AMF Bowling, Inc., Richmond, Va.

[21] Appl. No.: 155,658

[22] Filed: Jan. 21, 1988

Related U.S. Application Data

[63] Continuation of Ser. No. 918,686, Oct. 14, 1986, which is a continuation of Ser. No. 678,304, Dec. 5, 1984, abandoned.

[51] Int. Cl.[4] ..... A63D 5/04

[52] U.S. Cl. ..... 273/54 C; 273/1 ES; 340/731

[58] Field of Search ..... 340/731; 273/54 C, 1 ES, 273/1 E, 85 G, DIG. 28; 434/307

[56] References Cited

U.S. PATENT DOCUMENTS

| | | | |
|---|---|---|---|
| 4,127,849 | 11/1978 | Okor | 273/DIG. 28 |
| 4,131,948 | 12/1978 | Kaenel | 273/54 C |
| 4,295,135 | 10/1981 | Sukonick | 340/731 |
| 4,518,361 | 5/1985 | Conway | 434/307 |
| 4,630,039 | 12/1986 | Shimada | 340/731 |
| 4,682,161 | 7/1987 | Bugg | 340/731 |

*Primary Examiner*—Leo P. Picard

*Attorney, Agent, or Firm*—Bacon & Thomas

[57] ABSTRACT

A bowling scoring display in which the score of a bowling game may be displayed in a selected one of a plurality of different display formats. As example, the number of bowlers whose scores are displayed may be changed, and the number of frames of a bowling game that are displayed may be changed. As a general rule, the fewer the number of players and/or frames that are displayed, the larger the alpha-numeric characters used in the display.

13 Claims, 26 Drawing Sheets

LATCHING NETWORK

GRAPHICS CONTROL LOGIC

VIDEO MEMORY

SHIFT REGISTERS

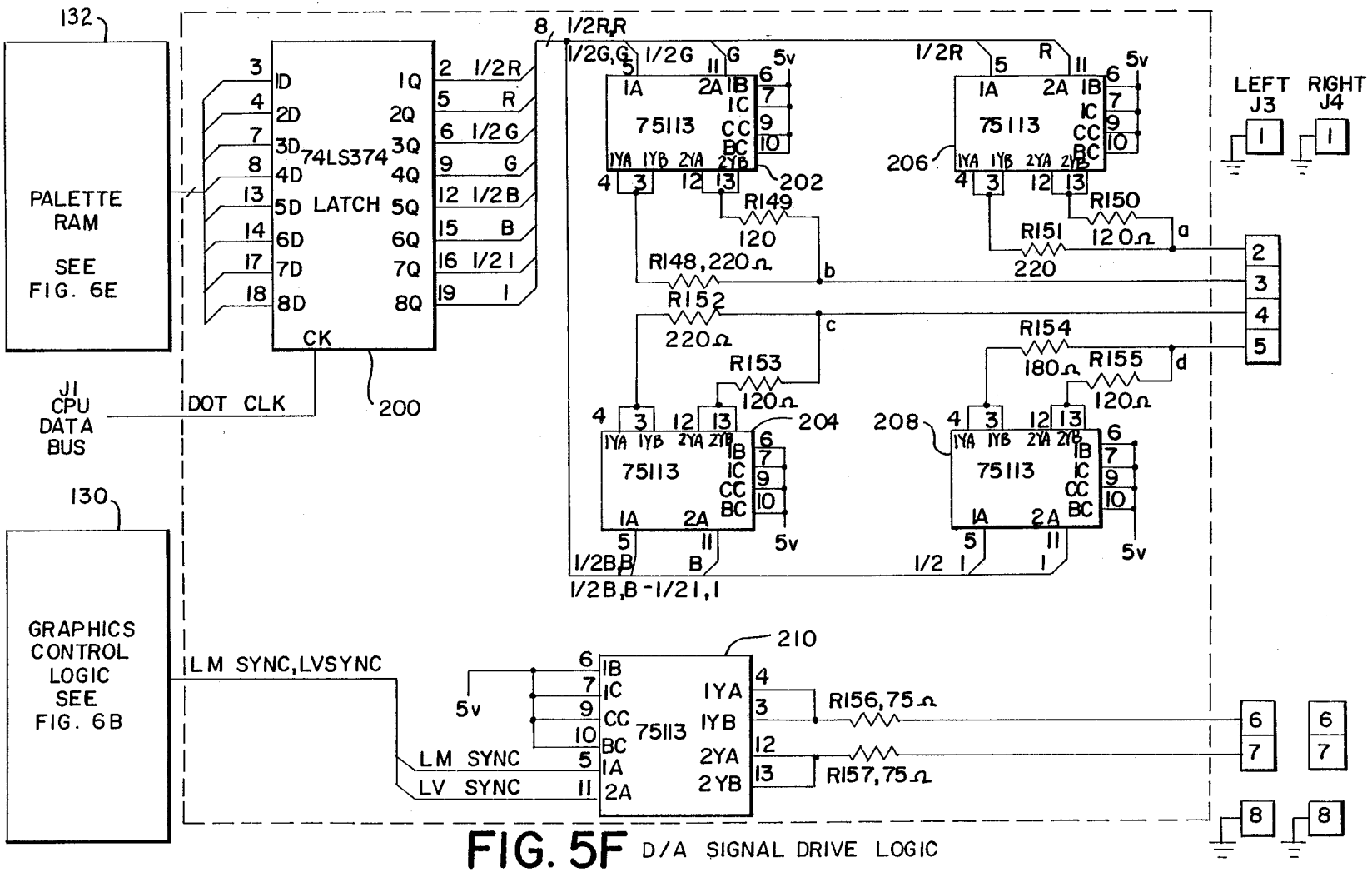
FIG. 5F D/A SIGNAL DRIVE LOGIC

SOFTWARE SYSTEM ARCHITECTURE

BOOTINIT FLOWCHART

SYSINIT
FLOWCHART

LEVPROC
FLOWCHART

COMMAND INTERPRETER
FLOWCHART

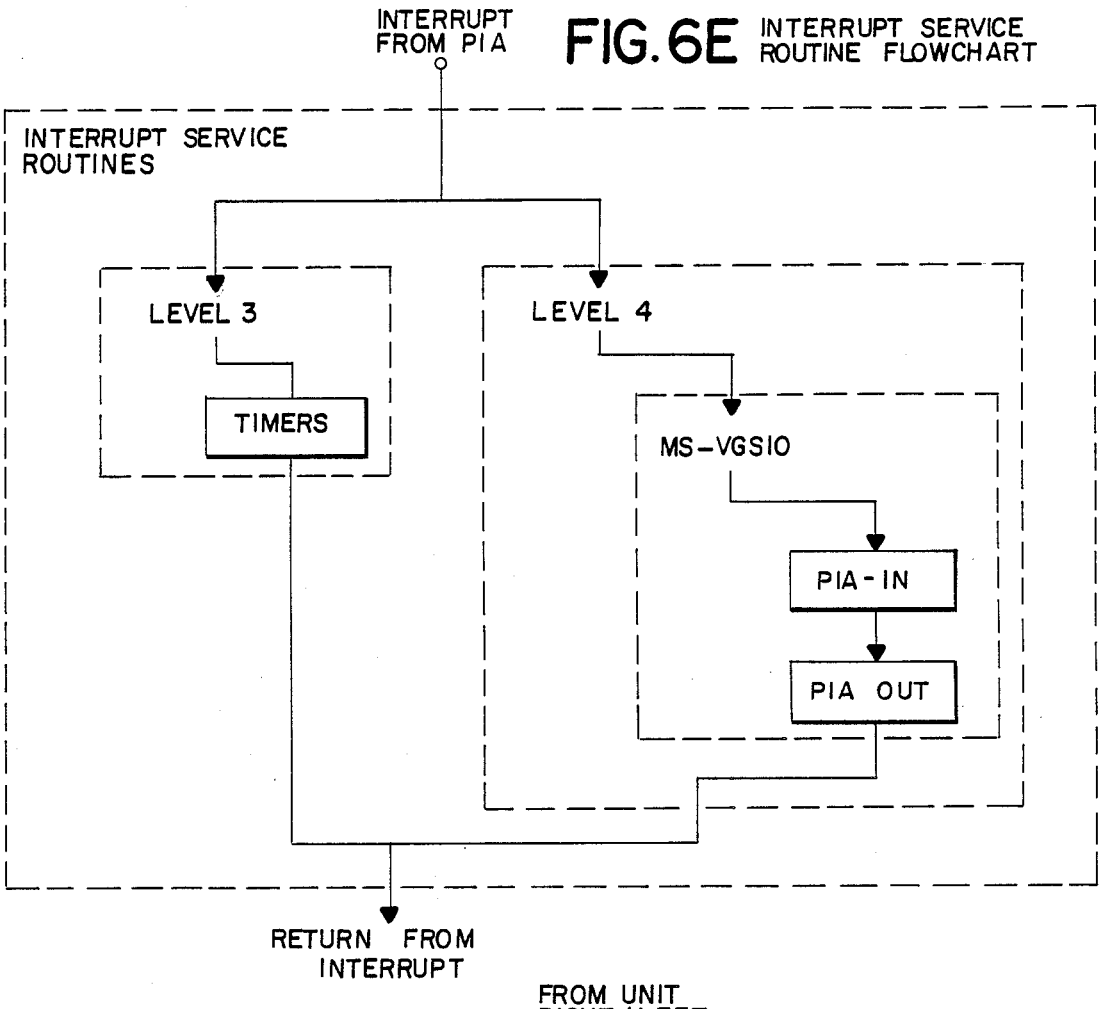
FIG. 6E INTERRUPT SERVICE ROUTINE FLOWCHART
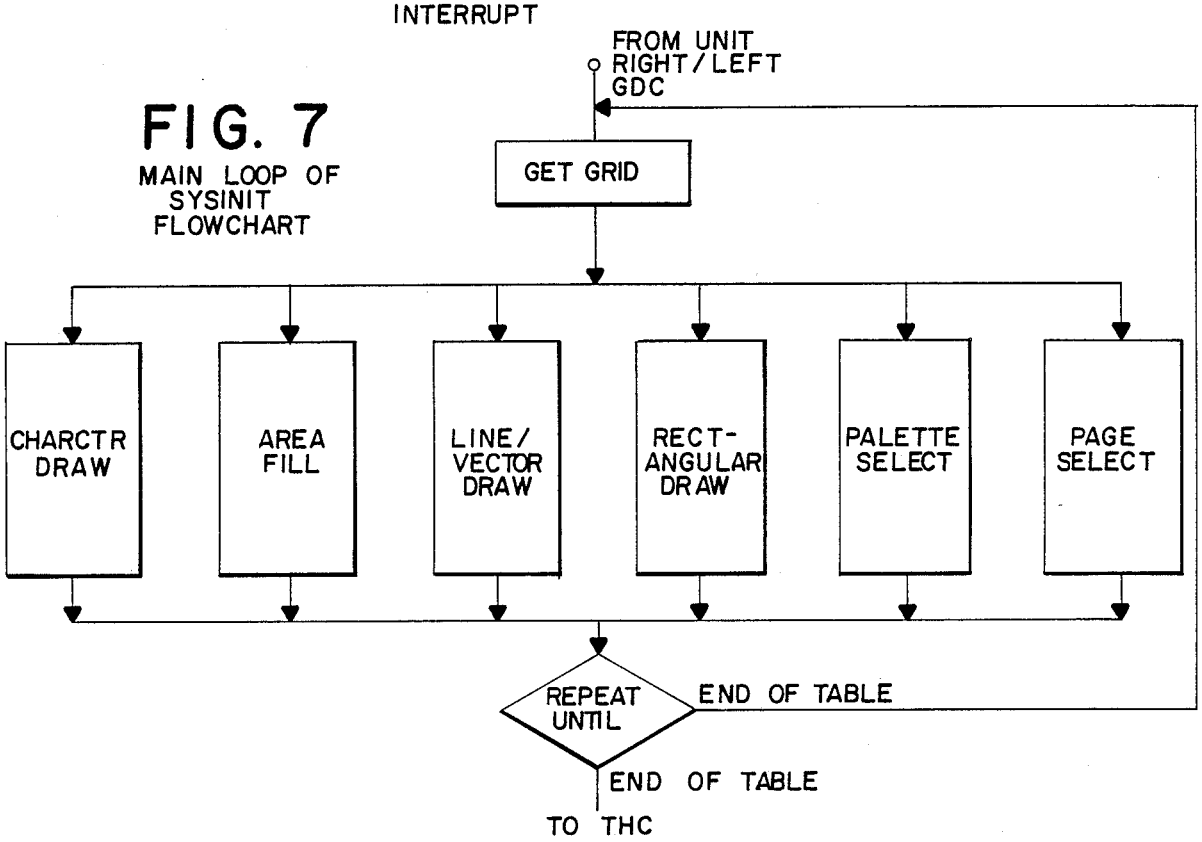
FIG. 7 MAIN LOOP OF SYSINIT FLOWCHART

CHARACTER DRAW FLOWCHART

AREA FILL FLOWCHART

LINE / VECTOR FLOWCHART

RECTANGULAR DRAW FLOWCHART

DATA TRANSFER
FLOWCHART

FIG. 8A BOWLER 3 FLOWCHART
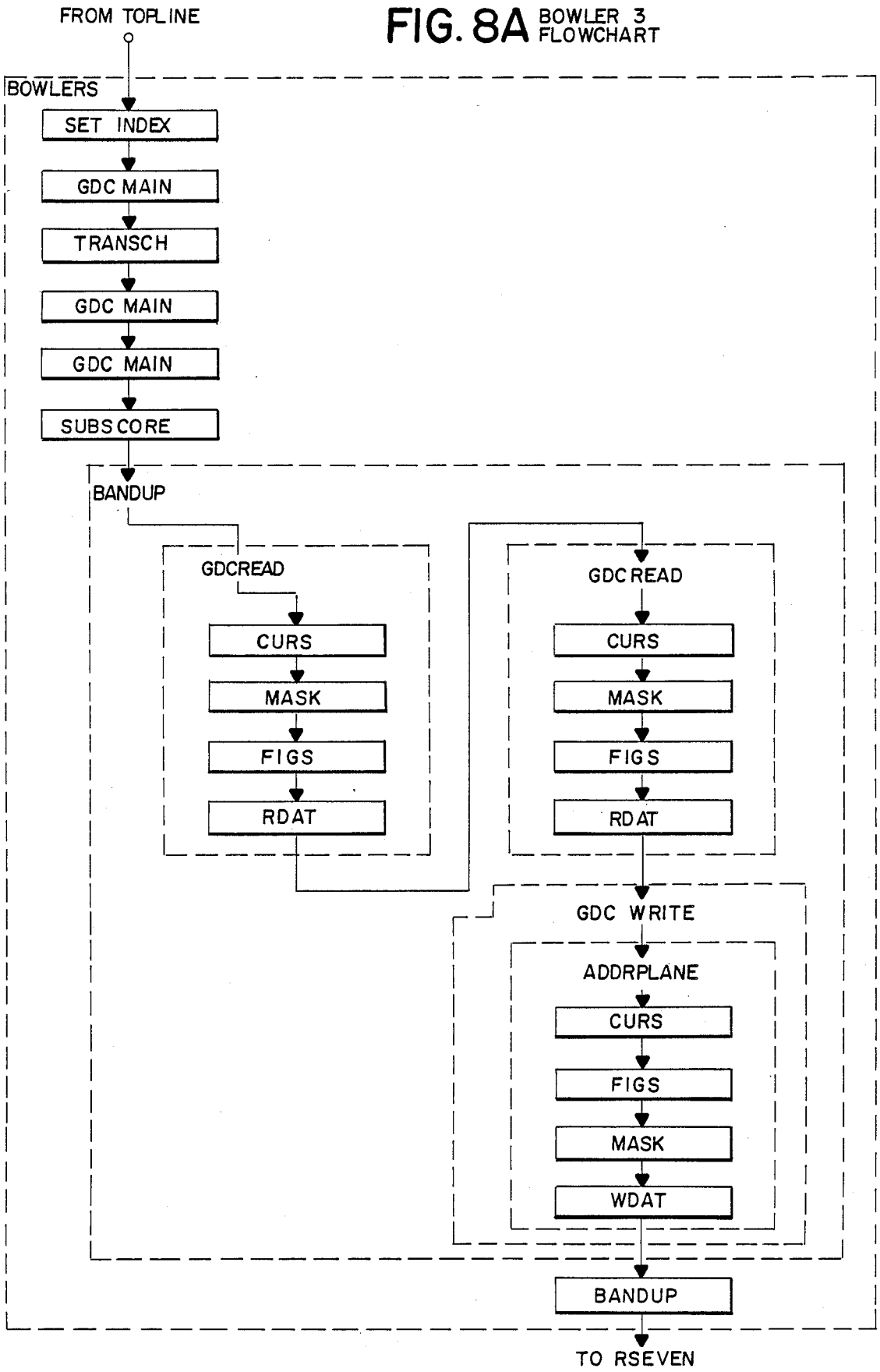

FORMAT SELECT

STRIKERS

| 56 | 1 | 2 | 3 | 4 | 5 | 6 | 7 | 8 | 9 | 10 | HDP |
|---|---|---|---|---|---|---|---|---|---|---|---|
| CN | X<br>29 | X<br>49 | 9/<br>65 | 63<br>74 | X<br>94 | 7/<br>110 | 6/<br>130 | X<br>150 | 4/<br>163 | 3/6<br>179 | 44<br>223 |
| JR | 8/<br>19 | 9-<br>28 | 7/<br>44 | 6/<br>64 | X<br>84 | 8/<br>99 | 5/<br>118 | 9/<br>131 | 3/<br>150 | 9/8<br>168 | 32<br>200 |
| BA | 5/<br>20 | X<br>48 | X<br>68 | 8/<br>88 | X<br>106 | 62<br>114 | 9/<br>129 | 54<br>138 | X<br>161 | X3/<br>181 | 16<br>197 |
| GW | X<br>30 | X<br>60 | X<br>90 | X<br>120 | X<br>150 | X<br>180 | X<br>210 | X<br>240 | X<br>270 | XXX<br>300 | 07<br>307 |
| BH | 4/<br>20 | X<br>40 | 6/<br>53 | 36<br>62 | 6/<br>80 | 81<br>89 | X<br>118 | X<br>138 | 9/<br>156 | 8/8<br>174 | 99<br>273 |
| | | | | | | | | | | 1200 | TH<br>198 |

FIG. 10

| STRIKERS | | | | | | |
|---|---|---|---|---|---|---|
| 56 | 6 | 7 | 8 | 9 | 10 | HDP |
| CN | 7/ 110 | 6/ 130 | X 150 | 4/ 163 | 3/6 179 | 44 223 |
| JR | 8/ 99 | 5/ 118 | 9/ 131 | 3/ 150 | 9/8 168 | 32 200 |
| BA | 62 114 | 9/ 129 | 54 138 | X 161 | X3/ 181 | 16 197 |
| GW | X 180 | X 210 | X 240 | X 270 | XXX 300 | 07 307 |
| BH | 81 89 | X 118 | X 138 | 9/ 156 | 8/8 174 | 99 273 |
| | | | | | 1200 | 198TH |

FIG. 11

| STRIKERS | | | | | | |
|---|---|---|---|---|---|---|
| 56 | 6 | 7 | 8 | 9 | 10 | HDP |
| CN | 7/ 110 | 6/ 130 | X 150 | 4/ 163 | 3/6 179 | 44 223 |
| JR | 8/ 99 | 5/ 118 | 9/ 131 | 3/ 150 | 9/8 168 | 32 200 |
| BA | 62 114 | 9/ 129 | 54 138 | X 161 | X3/ 181 | 16 197 |
| | | | | | 620 | TH 92 |

FIG. 12

| STRIKERS | | | | | | | | | | | |
|---|---|---|---|---|---|---|---|---|---|---|---|
| 56 | 1 | 2 | 3 | 4 | 5 | 6 | 7 | 8 | 9 | 10 | HDP |
| CN | X<br>29 | X<br>49 | 9/<br>65 | 63<br>74 | X<br>94 | 7/<br>110 | 6/<br>130 | X<br>150 | 4/<br>163 | 3/6<br>179 | 44<br>223 |
| JR | 8/<br>19 | 9–<br>28 | 7/<br>44 | 6/<br>64 | X<br>84 | 8/<br>99 | 5/<br>118 | 9/<br>131 | 3/<br>150 | 9/8<br>168 | 32<br>200 |
| BA | 5/<br>20 | X<br>48 | X<br>68 | 8/<br>88 | X<br>106 | 62<br>114 | 9/<br>129 | 54<br>138 | X<br>161 | X3/<br>181 | 16<br>197 |
| GW | X<br>30 | X<br>60 | X<br>90 | X<br>120 | X<br>150 | X<br>180 | X<br>210 | X<br>240 | X<br>270 | XXX<br>300 | 07<br>307 |
| | | | | | | | | | | 927 | TH<br>99 |

FIG. 13

| STRIKERS | | | | | | |
|---|---|---|---|---|---|---|
| 56 | 3 | 4 | 5 | 6 | 7 | HDP |
| CN | 9/ 65 | 63 74 | X 94 | 7/ 110 | 6/ | 44 154 |
| JR | 7/ 44 | 6/ 64 | X 84 | 8/ 99 | 5/ | 32 131 |
| BA | X 68 | 8/ 88 | X 106 | 62 114 | 9/ | 16 130 |
| GW | X 90 | X 120 | X 150 | X | X | 11 161 |
| BH | 6/ 53 | 36 62 | 6/ 80 | 81 89 | — | 99 188 |
| BS | 8/ 68 | X 98 | X | X | — | 33 131 |
| BETTY HOBBS | | | | 142 | 895 | 231 TH |

FIG. 14

AMF ANGLE OPEN

SCOTT WERTHMAN 37

| 1 | 2 | 3 | 4 | 5 | 6 | 7 | 8 | 9 | 10 | TOT |
|---|---|---|---|---|---|---|---|---|---|---|
| X | X | 9/ | 63 | X | 7/ | 6/ | X | 4/ | 3/6 | |
| 29 | 49 | 65 | 74 | 94 | 110 | 130 | 150 | 163 | 179 | 179 |

SERIES 397

FIG. 15

AMF ANGLE OPEN

BILL SCHAFFER

| 1 | 2 | 3 | 4 | 5 | 6 | 7 | 8 | 9 | 10 | TOT |
|---|---|---|---|---|---|---|---|---|---|---|
| X | X | 9/ | 63 | X | 7/ | 6 | | | | |
| 29 | 49 | 65 | 74 | 94 | 110 | → | | | | 110 |

SERIES 397

JERRY COOK

| 1 | 2 | 3 | 4 | 5 | 6 | 7 | 8 | 9 | 10 | TOT |
|---|---|---|---|---|---|---|---|---|---|---|
| 8/ | 9- | 7/ | 6/ | X | 8/ | | | | | |
| 19 | 28 | 44 | 64 | 84 | | | | | | 84 |

SERIES 408

FIG. 16

BOWLING SCORING DISPLAY SYSTEM

This application is a continuation of application Ser. No. 918,686 filed Oct. 14, 1986 which is a continuation of application Ser. No. 678,304 filed Dec. 5, 1984 now abandoned.

BACKGROUND OF THE INVENTION

This invention relates to a video presentation system for a bowling scoring system. It now is commonplace in bowling establishments to have apparatus that automatically detects the number of bowling pins knocked down by a bowler, and to have apparatus that receives pinfall data signals and automatically computes the bowler's score according to the scoring rules of the American Bowling Congress. It also is commonplace to display the bowling scores on cathode ray tubes (CRT's) located in the bowling area so that bowlers and spectators can view the running scores of the bowlers. A common arrangement is to place a pair of cathode ray tubes and automatic scoring apparatus adjacent a respective pair of bowling lanes to display scores of bowlers using that pair of lanes.

The bowling scoring apparatus at the pair of lanes is in a bowler's console that includes a data input means such as a keyboard to input bowler names, handicaps, and to produce certain signals for control of pin setting and sensing equipment, the scoring apparatus, the display means, and possibly to communicate to the manager's console at the front desk and with other consoles and apparatus in the establishment. Commonly, one bowler's console serves two adjacent lanes. The apparatus functions to keep track of a bowler's bowling lane as he bowls on one and the other in accordance with bowling league rules, or it can function to accommodate non-league (open) bowling where a bowler bowls his entire game on one lane.

As examples of apparatus of the type described above, reference is made to the following U.S. patents relating to the detection of bowling pins that remain standing after a ball is rolled. 4,140,314; 4,148,480; and 4,148,481. The following U.S. patents relate to automatic scoring apparatus: 3,700,236; 4,092,727; and 4,302,010. U.S. Pat. Nos. 4,302,010; 4,131,948; RE 28,503; as well as the above mentioned patents disclose apparatus for displaying bowling scores on cathode ray tubes. All the above patents are assigned to applicants' assignee and their teachings are incorporated herein by reference.

The game of bowling can be played under diverse situations, such as league or open bowling, as mentioned above, head-to-head bowling where only two bowlers compete against each other, and a lone bowler, as some examples. It is desirable that the presentation of the bowling scores on the CRT be flexible and versatile so that the scores can be selectively displayed most advantageously for whatever bowling situation is present. Furthermore, it promotes interest in the game of bowling to present the scores to bowlers and spectators in meaningful and interesting ways.

The present invention is directed to electronic apparatus for controlling the presentation of bowling scores on color CRTs to provide varied and interesting displays. The invention permits the bowlers or the establishment manager to select display formats having different characteristics such as character size or style. Furthermore, the invention may selectively cause the entire bowling scorecard grid and running frame scores to be displayed on the face of the CRT, or only a portion of the scorecard grid and a number of the most recently bowled frames or some number of frames less than all frames. For example, it might be desirable to show only the five most active frames for each bowler in order to improve the visibility of the scoring display.

If six bowlers are bowling on a league team, for example, the establishment manager may select a display format characterized by a scorecard grid pattern having six horizontal bands, one for each bowler. In this instance the characters for the names, scores, and other legends and writings will be of a relatively small size to fit the entire team scoring in substantially a given area on the face of the CRT. If only five bowlers are present on a league team, the apparatus senses that only five player's names have been entered into the bowlers console and automatically reformats the display for a five player scoresheet grid. The size of the grid blocks and the dimensions of the alpha-numeric characters are proportioned to be larger than for a six player format. Alternatively, the reformatting could be accomplished in response to commands from the manager's console at the front desk or from the bowler's console. In this instance format change, characters of the names, score, etc. are larger in size in the vertical direction so as to be more visible. Further, as mentioned above, the manager, or the bowlers, may select video format commands at their respective keyboards to cause some number less than all of the frames to be displayed on the grid format. For head-to-head match between two bowlers, the manger can cause only two bands of scoring grid to be displayed and only the two bowler's names and scores will be shown in the grid. The grid dimensions and character sizes may be much larger than for league play, for example, so that they fill a substantial portion of the CRT face and are visable for a great distance. Further, if desired, a fewer number than all the frames may be displayed, again enlarging the dimensions of the grid and characters, if desired.

In addition to the above mentioned characteristics of a bowling scoring display that may be changed or selected, the characteristic of colors in the display may be selected or changed. For example, the manager may select video format commands at his keyboard to cause the scorecard grid to be one color, the background of the CRT face to a second color, and the name and score characters to be one or more different colors, and the band across the face of the CRT that contains the "up" bowler's name and scorecard grid may be yet a different color that may not be flashed on and off for emphasis.

In a presently preferred embodiment of this invention, video graphic command signals corresponding to the various selectable scorecard grids and alpha-numeric characters to be selectively displayed are stored at respective locations in storage or database means in the apparatus. Video format command signals corresponding to the desired format display characteristic are entered at the bowler's and/or manager's console to call from the score means the desired graphic control signals that cause the CRT to display the selected score grid and alpha-numeric signals.

The video generation circuitry is extremely versatile due to the fact that it is implemented by a method known as "bit mapping". Bit mapped displays allow complete freedom of character size and placement on the CRT face. This freedom is due to the fact that characters are drawn on the CRT face a bit, i.e., pixel, at a time, as opposed to the character being permanently defined in a non volatile memory chip. This allows mathematical algorithms to be used to scale and position the characters to fit in any particular format selected. The "bit mapped" display also will allow very simple implementation of new formats and special characters such as Katakana, a Japanese alphabet. A pixel is defined as the smallest dot of color which can be individually turned on or off on the face of a CRT by the video generation circuitry.

As previously stated and explained, the video graphic commands signals for the different grids and characters are stored and the video format command signals put in at the manager's or bowler's keyboard causes the selected formats to be retrieved from the memory and displayed as the game progresses. Alternative means might be employed wherein the video format commands ultimately control one or more grid and character generators to directly generate the necessary video graphic commands to actively produce the desired format characteristic in the display. In other words, the video format commands would not be sotred, but would be actively generated as needed for the display selected.

DESCRIPTION OF FIGURE

FIG. 5F illustrates a detailed diagram of the D/A signal drive logic 136 of the graphics controller board 50.

FIG. **6*a*** illustrates a detailed flowchart of the Bootinit routine within the software systems architecture.

FIG. **6*b*** illustrates a detailed flowchart of the Sysinit routine within he software systems architecture.

FIG. **6*c*** illustrates a detailed flowchart of the LEVPROC routine within the software systems architecture.

FIG. **6*d*** illustrates a detailed flowchart of the command interpreter routine within the software systems architecture.

FIG. **6*e*** illustrates a flowchart of the interrupt service routine.

FIG. 7 illustrates the GDC Main loop of the Sysinit routine.

Figure 7A:
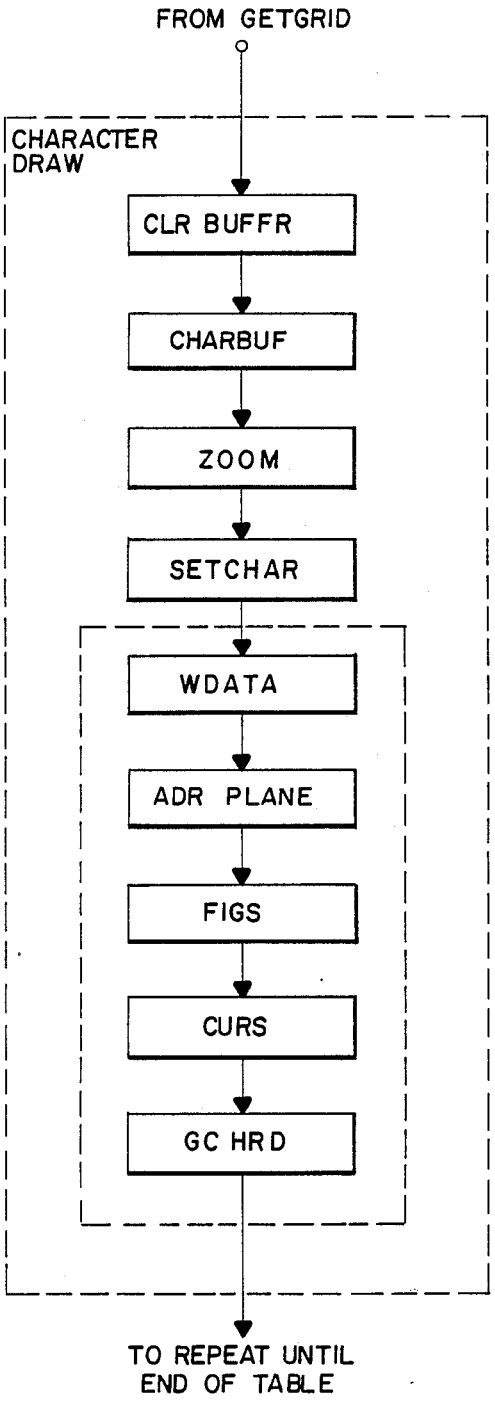

FIG. 7A illustrates a detailed flowchart of the character draw routine in the GDC Main loop routine.

FIG. **7*b*** illustrates a detailed flowchart of the Area Fill routine in the GDC Main loop routine.

FIG. **7*c*** illustrates a detailed flowchart of the line/-vector routine in the GDC main loop routine.

FIG. **7*d*** illustrates a detailed flowchart of the rectangular draw routine an the GDC Main loop routine.

Figure 8:
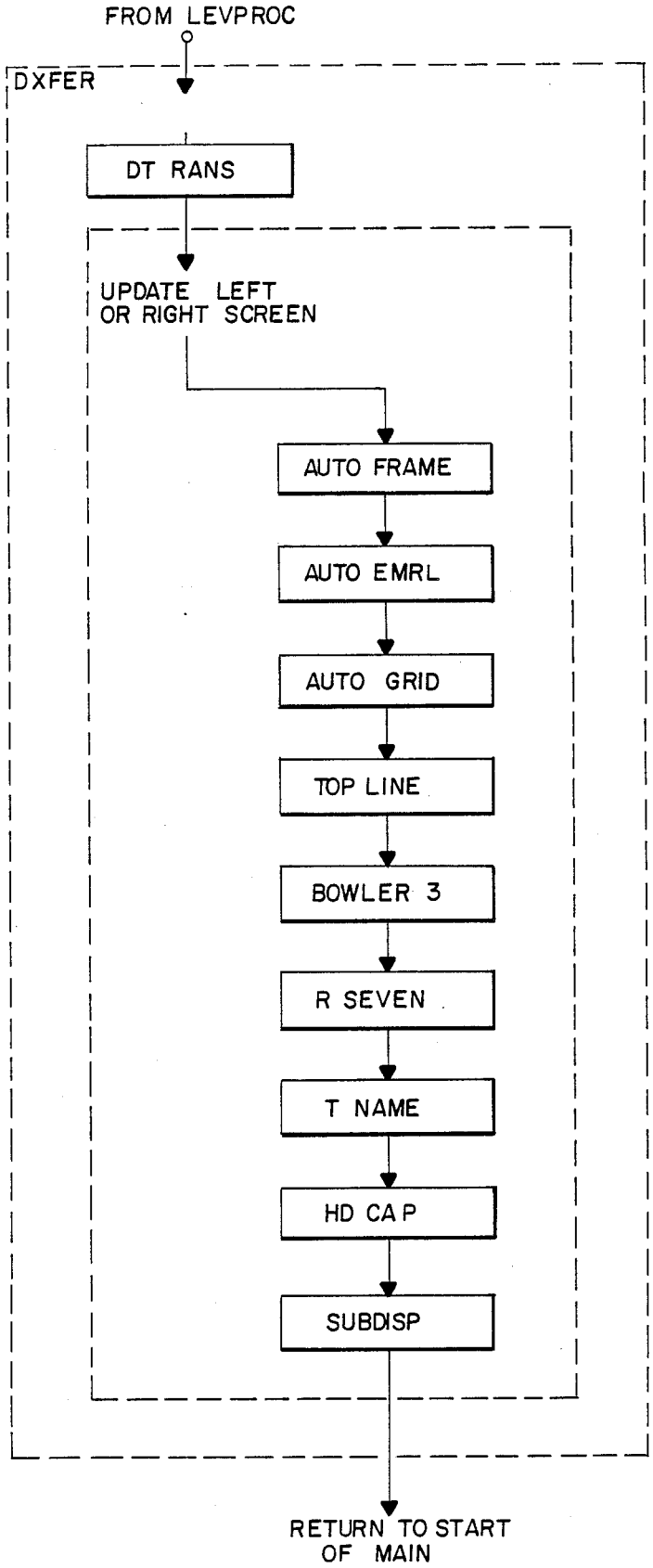

FIG. 8 illustrates a detailed flowchart of the data transfer routine in the command interpreter routine.

FIG. **8*a* illustrates a detailed flowchart of the bowler 3** routine in the data transfer routine.

Figure 9:
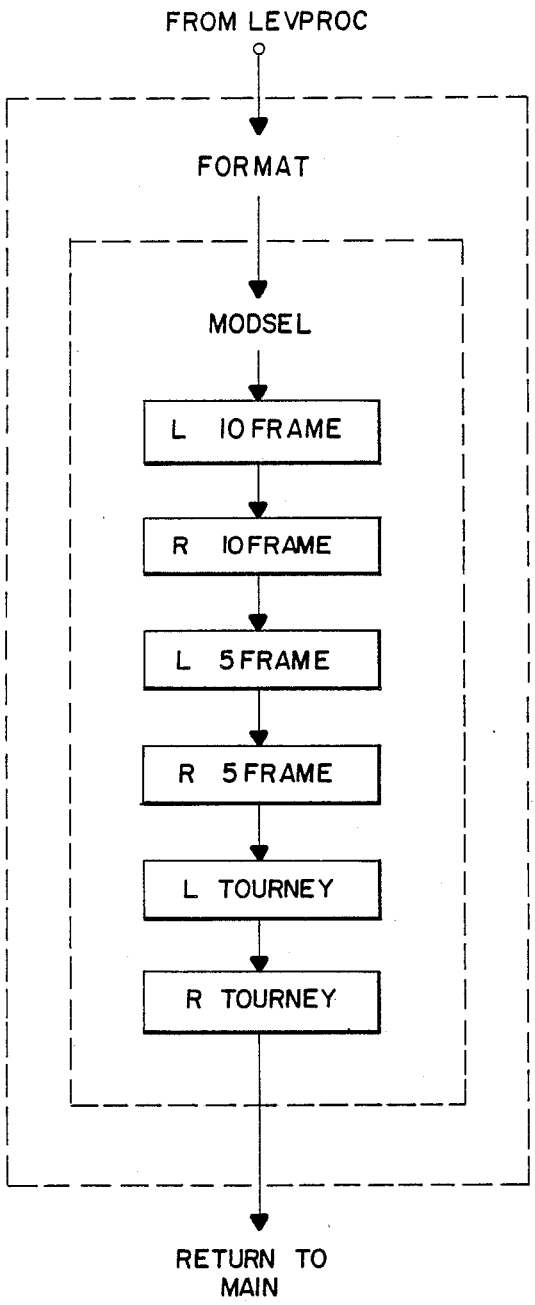

FIG. 9 illustrates a detailed flowchart of the format routine in the command interpreter routine.

FIG. 10 illustrates a 10 frame 5 bowler grid format displayed on the CRT.

FIG. 11 illustrates a 5 frame 5 bowler grid format displayed on the CRT.

FIG. 12 illustrates a 5 frame 3 bowler grid format displayed on the CRT.

FIG. 13 illustrates a 10 frame 4 bowler grid format displayed on the CRT.

FIG. 14 illustrates a 5 frame 6 bowler grid format displayed on the CRT.

FIG. 15 illustrates a tournament mode grid format with a display of one bowler per screen.

FIG. 16 illustrates a tournament mode grid format with a display of two bowlers per screen.

DETAILED DESCRIPTION OF THE PREFERRED EMBODIMENT

Figure 1:
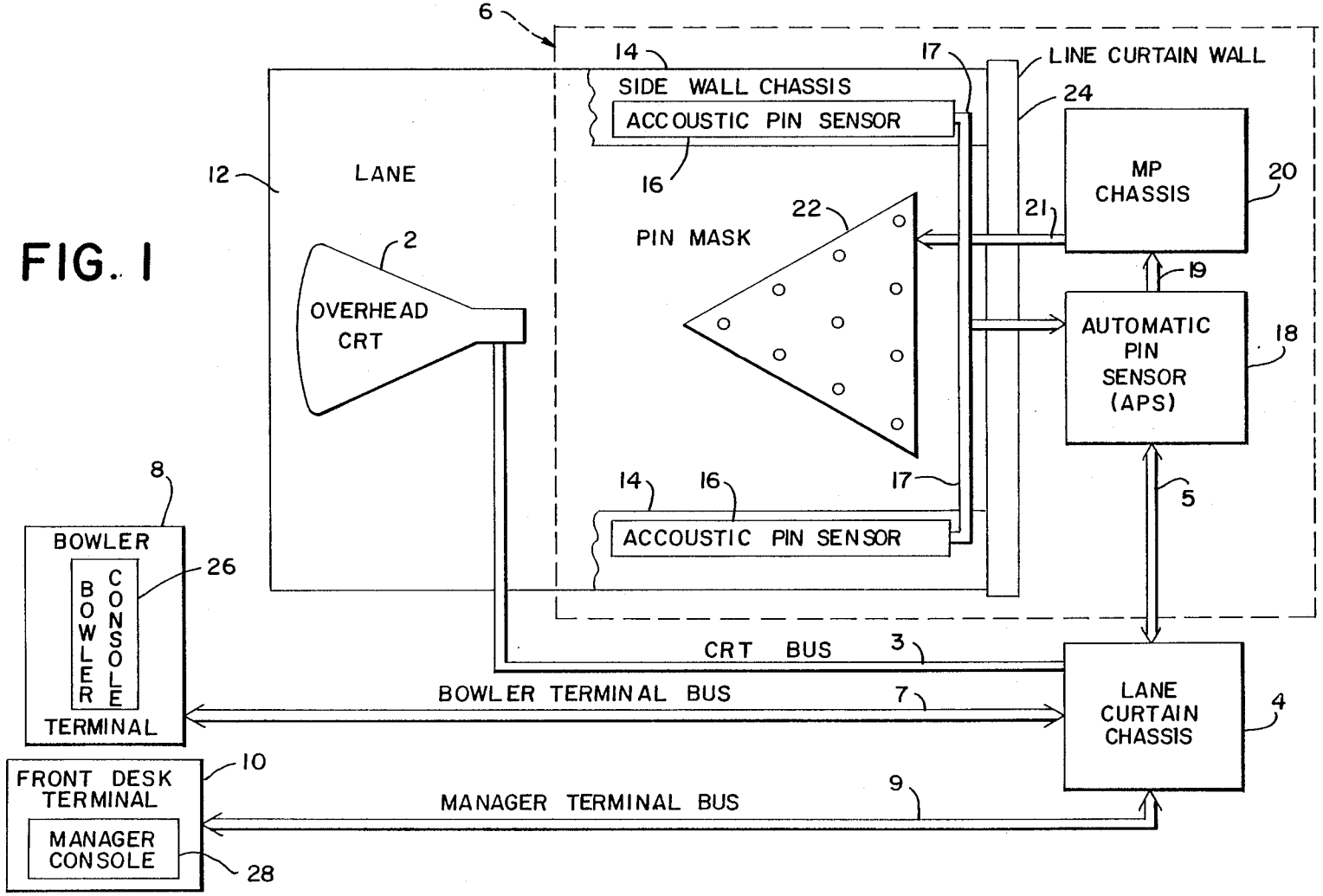
FIG. 1 illustrates a general overview of a bowling scoring system with an overhead CRT display.

FIG. 1 is a simplified representation of an automatic bowling score system with a color cathode ray tube displaying the bowling game score information. As shown in FIG. 1, the overhead cathode ray tube 2 displays video signals received from the lane curtain chassis 4 via the CRT bus 3. Keyboard inputs, depressed at bowler terminal 8 on bowler console 26, or at manager terminal 10 on manager console 28, send a stream of ASCII characters, respectively, via bowler terminal bus 7, or manager terminal bus 9, to the lane curtain chassis 4. An acoustic pin sensor 16 located within the sidewall chassis 14 on each side of the lane 12 senses pinfall on lane 12 and produces corresponding signals that are coupled to the automatic pin sensor (APS) electronic system 18 via bus 17. APS 18 converts this analog signal to a digital pinfall count and couples pinfall count signals to the MP chassis 20 via bus 19. MP chassis 20 controls the pin mask 22 via bus 21 to light the appropriate pinfall pattern, as well as the pinsetting apparatus as is known in the art. Reference is made to U.S. Pat. Nos. 4,140,314, 4,148,480 and 4,148,481 incorporated herein by reference, for a description of suitable apparatus and signal processing means for detecting pinfall and producing pinfall count signals. Additionally, APS 18 couples the pinfall count to the lane curtain chassis 4 via bus 5. Both keyboard and pinfall inputs cause the lane curtain chassis 4 to update the CRT display. The CRT 2 primarily displays bowling game score information that includes pinfall count, a bowling score grid and a background display of one of a plurality of colors. Additionally, messages, advertisements and commercial television programming coupled from front desk terminal 10 can be displayed on overhead CRT 2. In practice, two CRTs will be at the overhead location, each one scoring for a respective one of two teams that are bowling on a pair of lanes, for example.

Figure 2:
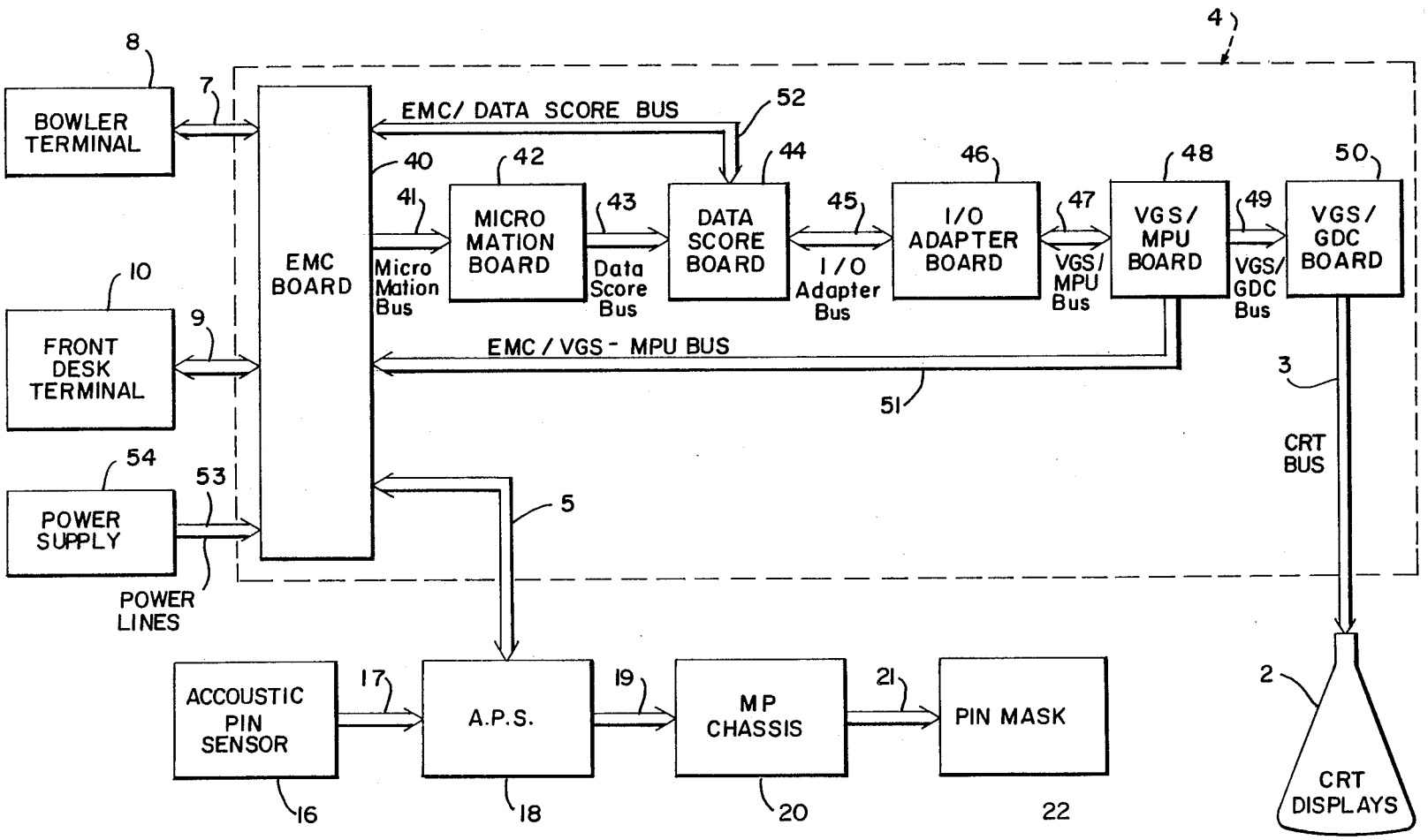
FIG. 2 illustrates a block diagram of the hardware systems architecture.

FIG. 2 illustrates the lane curtain chassis 4, a self-contained housing of digital electronics fixed on the lane curtain wall 24, that independently drives a given lane pair of CRTs. All communication to and from the lane curtain chassis 4 are conducted through the EMC board 40. The EMC board 40 provides two functions: (1) connecting communication lines external to the system and (2) filtering all lines by supressing EMI and ESD noise spikes. Functionally, the micromation board 42 monitors keyboard entries by accepting the stream of ASCII characters from the bowler terminal 8. Keyboard entries 18 are channeled to the data score board 44 via data score bus 43. Pinfall count signals from the APS 18 are channeled to the data score board 44 via EMC/DATA scorer bus 52. The data score board 44 processes this information by computing bowler scores according to scoring rules of the American Bowling Congress.

Responses to keyboard inputs are channeled via micromation bus 41, through the EMC board 40, back to the bowler terminal 8 via bus 7, or via the EMC/Data scorer bus 52, through the EMC board 40, back to the Front Desk Terminal 10 via bus 9. In addition, the data score board 44 channels the computed bowling game score information to the video graphics system (VGS) which displays it on a selected CRT 2.

The I/O adapter board 46 interfaces the previously described automatic scoring system by connecting that system to a more powerful VGS via I/O adapter bus 45. The I/O adapter board 46 expands the resources of the previous automatic bowling scoring system by adding extra memory and parallel communication lines. The I/O adapter board channels data to the VGS/MPU board 48 (hereafter MPU board 48) via the VGS/MPU bus 47. The MPU board 48 is a microprocessor based architecture whose primary function is to drive a pair of graphics display controller chips on the VGS/GDC board 50 (hereafter GDC board 50). The MPU board 48 and the GDC board 50 combine to form the VGS, interfaced via the VGS/GDC bus 49. The GDC board 50 consists of two identical channels to drive the left CRT display and the right CRT display on a pair of CRTs. The GDC architecture includes a pair of graphics controller chips that provide the MPU board 48 with timing and access capability to the video graphics RAM in order to display that memory on the respective CRT displays 2, via the CRT bus 3. The EMC/VGS-MPU bus 51 connects the front desk terminal 10 to the MPU board 48, via the EMC board 40, allowing the downloading of VGS programming to debug and modify the VGS software.

Figure 3:
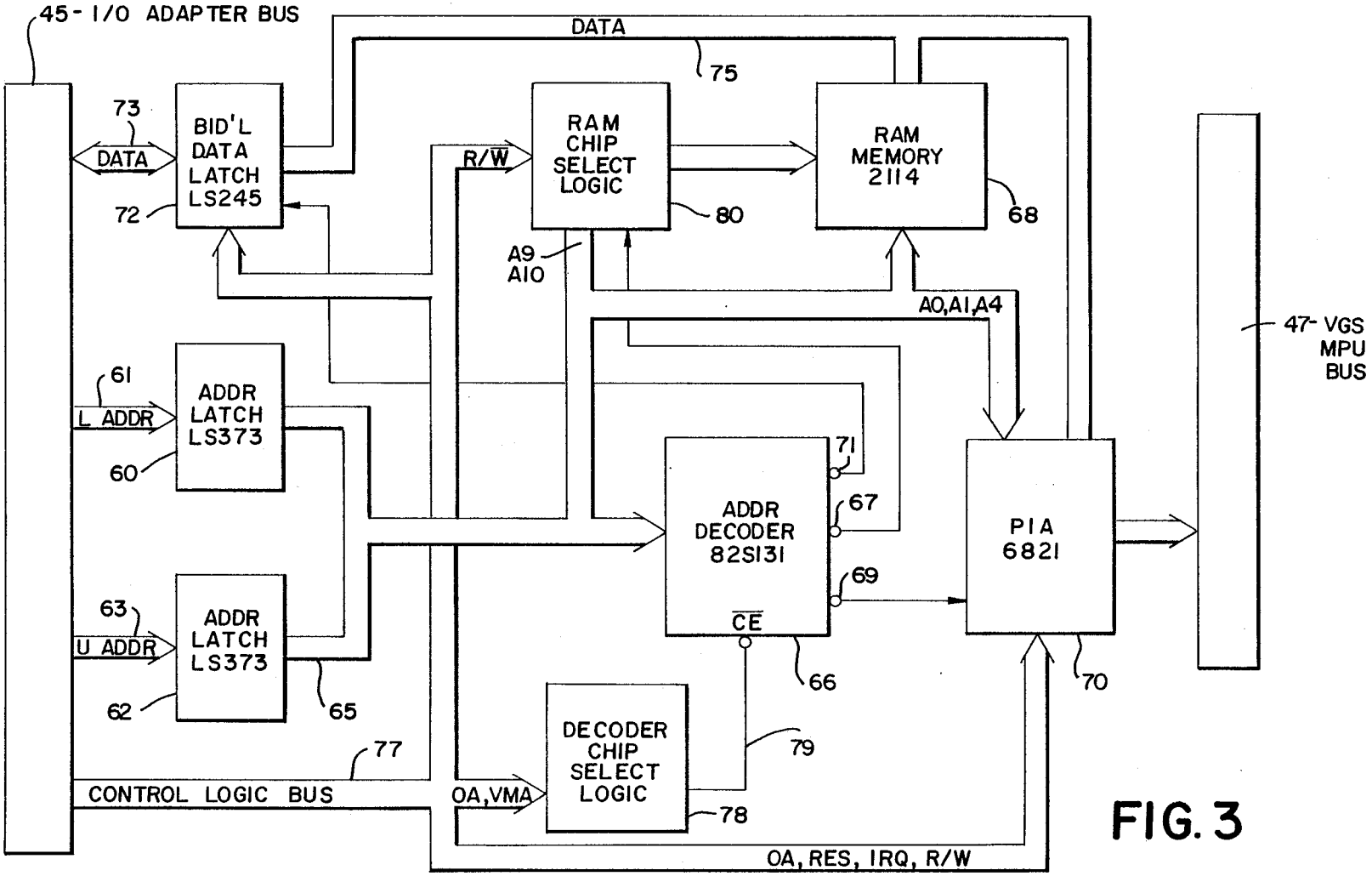
FIG. 3 illustrates a more detailed view of the I/O adapter board 46.

FIG. 3 illustrates a more detailed view of the I/O adapter board 46. The I/O adapter board 46 provides parallel communication between the data score board 44 and the MPU board 48, and expands the RAM of the present system. The I/O adapter bus channels the 8-bits of data, 16-bit address and control logic from the data score board 44 to the VGS. To achieve parallel communication from the data score board 44 to the MPU board 48, the bidirectional data latch 72 is loaded with 8-bits of data and then the peripheral interface adapter (PIA) 70 is signalled to communicate that data to the VGS/MPU bus 47. First, the 16 address bits pass through buses L ADDR 61 and U ADDR 63 and latch into address latch 60 and address latch 62. The address bus 65 carries these latched addresses to the address decoder 66. The control logic signals OA, VMA, RES, IRQ and R/W pass from the I/O adapter bus 45 to the control logic bus 77. The OA and VMA signals are coupled into the decoder chip select logic 78 that low enables the address decoder 66 along line 79. The enabled address decoder 66 produces the low enable signal along line 71 to the bidirectional data latch 72, latching the 8-bit data from I/O adapter bus 45. The data then is coupled from the bidirectional data latch 72 to the PIA 70 along data bus 75.

The next occurring address on I/O adapter bus 45 is latched by the address latches 60 and 62 and is decoded by address decoder 66 to produce the low enable signal along line 69, thereby enabling the PIA 70 to receive the data from bidirectional latch 72. Address lines A0, Al, and A4 pass through address bus 65 into the chip and register select pins of the PIA 70, and combine with control signals OA, RES, IRQ and R/W to enable and control the PIA 70 chip. After the PIA accepts the 8-bits data from latch 72 the PIA 70 places the data on the VGS/MPU Bus 47, thereby passing it to the MPU board 48.

The expansion of the previous system RAM is accomplished as follows. The RAM 68 is signalled to load 8-bits of bus into the bidirectional data latch 72, and then the bidirectional data latch 72 is signalled to pass the 8-bits to the I/O adapter bus 45. First, 16 address bits pass through buses L ADDR 61 and U ADDR 63 and latch into address latch 60 and address latch 62. The address bus 65 carries these addresses to RAM 68 and the address decoder 66. Control signals OA and VMA, passing through the control logic bus 77, are coupled into the decoder chip select logic 78, which low enables the address decoder along line 79. The enabled address decoder 66 signals a low enable to the RAM chip select logic 80 along line 67. The control logic bus 77 passes the control signal R/W into the RAM chip select logic 80, and address bus 65 passes address signals on lines A9 and A10 into the RAM chip select logic 80. These signals combine to enable and select the video RAM. Data passes from the RAM 68 along data bus 75 into the bidirectional data latch 72. Then, to pass the data from the bidirectional data latch 72 to the I/O adapter bus 45, a new address is latched and decoded in the same manner described above, and the decoder 66 produces the low enable signal along line 71, thereby enabling the bidirectional data latch 72. The above sequence would complete a read cycle. To write into RAM 68, first load the bidirectional data latch 72 with 8-bits of data, then signal the RAM 68 to accept this data by latching and decoding a new address to low enable line 67, along with the appropriate control logic, as described above.

Figure 4:
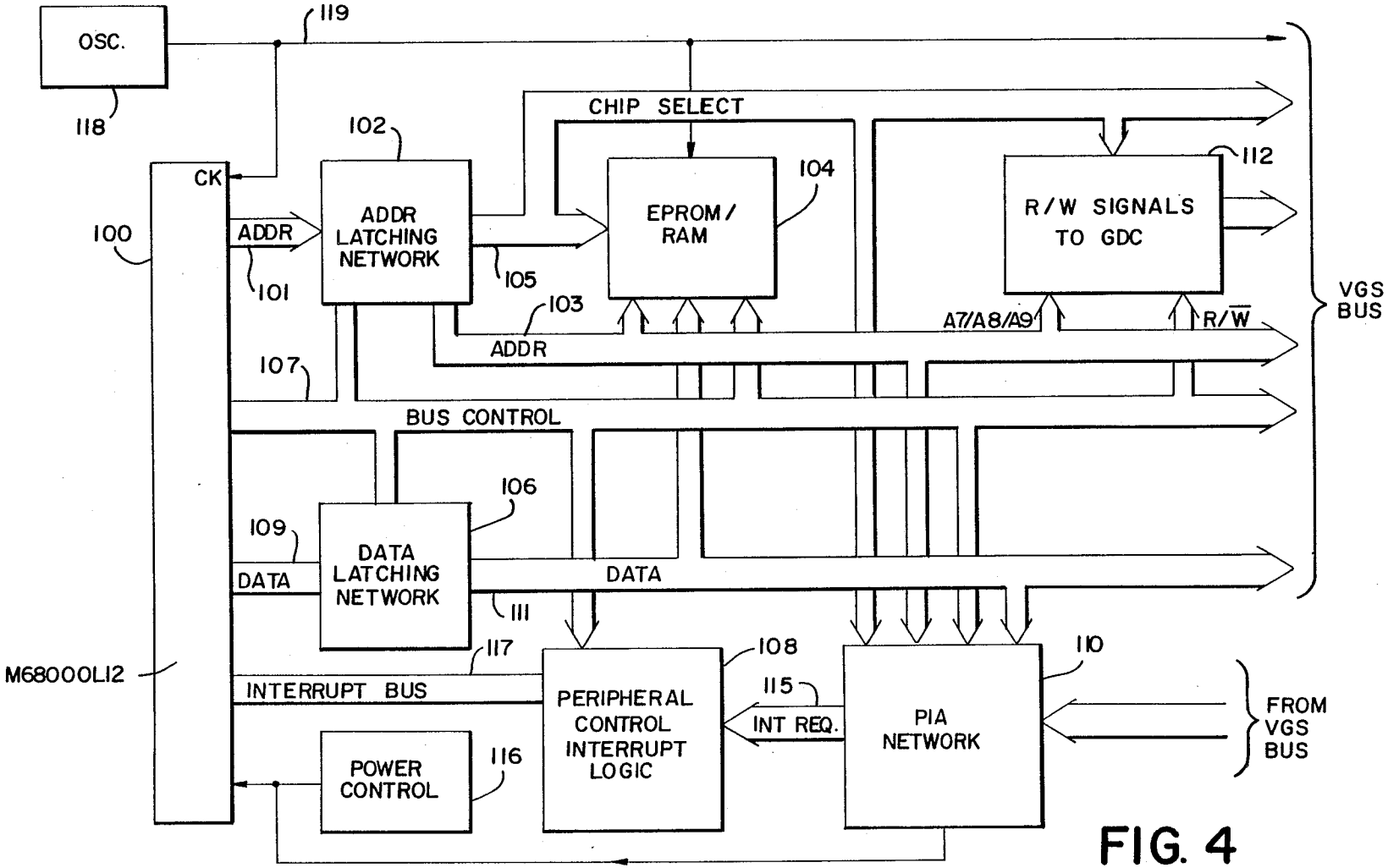
FIG. 4 illustrates a block diagram of the MUP Board 489, a traditional microprocessor board architecture.

FIG. 4 illustrates a block diagram of the MPU board 48, a traditional microprocessor based architecture including the Motorola 68000 16-bit microprocessor, (MSM 2764 EPROM and MSM 4164 RAM (EPROM/-RAM)), and peripheral interface adapters PI 110 (MC-68B21), and MC 68B50) ACIA (Asynchronous Communication Interface Adapter). Address bus 101 conducts the 24 address lines from microprocessor 100 to address latch 102. The address bus 103 routes addresses to the EPROM/RAM 104, PIA network 110, R/W signals network 112, and to the GDC bus 49. These address lines allow the microprocessor 100 to address memory locations at the EPROM/RAM 104, select a particular PIA chip in PIA network 110, and select a particular read/write function on the left or right channel of the GDC board 50 of FIG. 2. In addition, the address latch 102 demuliplexes the latched addresses, generating the chip select signals. Together, the latched addresses, via ADDR bus 103, and the chip select signals, via chip select bus 105, pass to the PIA 110 and R/W signal network 112 to accomplish the memory-mapped I/O architecture, very well known in the microprocessor art.

The memory-mapped I/O scheme allows the microprocessor to select a particular I/O function from the EPROM/RAM, R/W signals network 112 or the PIA network. Data bus 109 conducts the 16 data lines from the microprocessor 100 to the data latch network 106. The data bus 111 routes these latched data lines to the EPROM/RAM 104, PIA 110, and the GDC bus 49. These lines allow the microprocessor 100 to read or write data from EPROM/RAM 104, pass input/output data to and from the PIA network 100, and communicate video graphic data to the GDC board 50.

In both the address latching network 102 and the data latching network 106, the bus control signals on bus 107 allows the microprocessor 100 to arbitrate bus contentions that arise in a multichip environment by providing the suitable bus control lines to the address latch 102, data latch 106, EPROM/RAM 104, and PIA 110. The R/W signal network 112 generates the RDLGDC, RDRGDC, WRLGDC, WRRGDC signals to read/-write the left/right graphics display controllers and pass these signals to the GCD bus 49, thereby communicating the signals to the GDC board 50.

The PIA allows the microprocessor I/O communication of video graphics data from the data score board 44, and the ACIA from the front desk terminal 10 of FIG. 1. The data score board 44 communicates in 8-bit parallel form bowling game score information to the VGS. The ACIA communicates in high speed serial form messages, and programming from the front desk terminal 10.

The Peripheral Interrupt Control Logic (PICL) 108 signals the microprocessor 100 that a PIA device needs servicing. Interrupt request bus 115 carries the interrupt signal from the PIA network 110 to the PICL 108 where a priority encoder encodes the interrupt request and passes the interrupt signal via interrupt bus 117 into the microprocessor 100. Lastly, the power control circuitry 116, with a suitable network to form the signal, restarts the microprocessor 100 when power is applied to the board. The clock oscillator 118 passes clock pulses into the microprocessor 100, EPROM/RAM 104 and GDC bus 49. The simultaneous clock input signals to the microprocessor 100 and EPROM/RAM 104 synchronize the timing and memory access functions of the microprocessor 100. The input to the GDC bus 49 allows the MPU board 48 to synchronize itself to the GDC board 50. The EPROM/RAM 104 is used for storage of the program to perform the scoring display task and temporary variables and scores. The EPROMs contain program instructions to receive scores from the I/O Adapter baord 46 via bus 47, calculate new score information, transfer and control its display by the GDC board 50 via bus 49. Additionally the EPROM contains character, format and color definitions for drawing on the face of CRT 2 with the GDC board 50 via bus 49. The RAM in block 104 is used for receiving scores from I/O Adapter board 46 via bus 47. The RAM is also used to calculate new scores such as "pins ahead", format the scores into characters for display, and to hold temporary information such as which colors, format etc. to use. In conclusion, this traditional microprocessor based architecture is well known in the microprocessor art, and the Motorola 68000 advance sheet, that explain the function and timing of the chip, and "The M68000 Family", a brochure that introduces and explains a family of M68000 compatible peripherals, are both hereby incorporated by reference.

Figure 5:
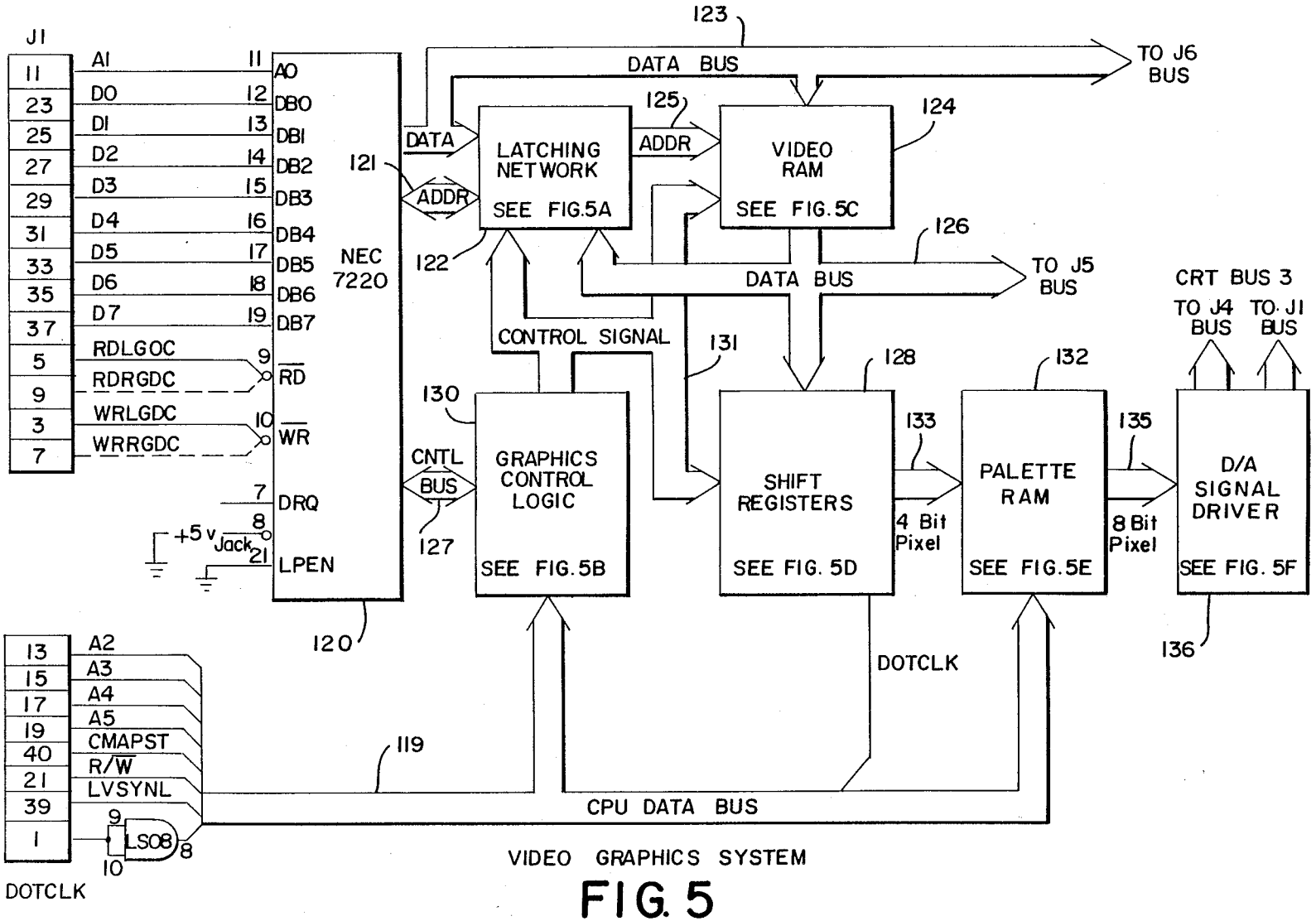
FIG. 5 illustrates a block diagram of the graphics controller board 50 in the video graphics system.

The MPU board 48 of FIG. 2 communicates with the GDC board 50 of FIG. 2 via the GDC bus 49, hereafter called J1. The GDC board 50 consists of a pair of video graphics channels, the left channel and right channel. In FIG. 5, each channel independently includes a NEC 7220 graphics display controllers 120, address and data latching network 122, video RAM 124, graphics control logic 130, shift registers 128, a palette RAM 132 and D/A signal drivers 136. Specifically, FIG. 5 illustrates the left channel of the VGS, the right channel being physically and operationally similar. The microprocessor 100 on the MPU board 48 is solely responsible for driving the pair of graphics display controllers 120. Each graphics display controller (GDC) 120 is exclusively dedicated to driving a respective left or right display on the overhead CRT 2. The GDC 120 is an intelligent microprocessor peripheral design that controls the timing and access to the video RAM 124 for the microprocessor 100 and provides high-resolution, raster-scan computer graphics and character display on the overhead CRT 2. The "NEC uPD7220" graphics display controller literature, hereby incorporated by reference, explains the operation of this device.

The MPU Board 48 inputs video data, commands, address lines, control signals and the clock signal to the GDC board 50 via J1. The video data is generated for a non-interlaced raster scan of 240 pixels for each of 512 scan lines, subsequently modified as the bowling game progresses with bowler names, game score information, messages, advertisements and commercial TV signals. The commands include video control commands, display control commands, drawing control commands, data read commands and direct memory access (DMA) control commands. The MPU board 48 will use these commands to instruct the GDC 120 to draw the contents of video RAM 124 on the CRT 2. Referring to FIG. 5, MPU board 48 inputs both the video data and commands in 8-bit parallel form from J1(23)—J1(37) to DBO(12)—DB(19) of the GDC 120. The address lines include A1, A2, A3, A4, A5. The MPU board 48 inputs address line A1 from J1(11) to A0(11) of the GDC 120 as an address select input for microprocessor interface, and inputs A2, A3, A4, A5 from J1(13)—J1(19) to the CPU data bus 119 as address lines to the palette RAM 132, explained more precisely in FIG. 5E. The control signals include RDLGDC, RDRGDC, WRLGDC, WRRGDC, CMAPST, R/W, LVSYNC and DOTCLK. The MPU Board 48 inputs the control signals RDLGDC, RDRGDC, WRLGDC, WRRGDC from J1(3)—J1(9) to RD(9) and WR(10) on the GDC 120 to signal the GDC 120 to read/write the left/right video RAM 124. Note that the dotted lines represent the respective signals to the right graphics channel for a given lane pair. The MPU board 48 inputs control signals CMAPST, R/W, LVSYNC from J1(40), J1(21), and J1(39) to the CPU data bus 119, explained more precisely in later figures. Lastly, the MPU board 48 inputs the DOTCLK from J1(1), through NAND gate 34 to the CPU data bus 119, to synchronize the functions on the MPU board 48 and GDC board 50. Note that DRQ(7) is left open, DACK(8) is tied to 5V and LPEN(21) is grounded on the GDC 120.

With the inputs from the MPU board 48, the GDC board 50 generates the video and sync signals necessary to display video data onto the respective overhead CRT 2. To load the video RAM with the game score information, first the GDC 120 latches the address along the address bus 121 into the address latch 122 and outputs appropriate control signals via the control bus 127 into graphics control logic 130. Via control signal bus 131, the graphics control logic 130 enables and clocks the address latching network 122 and the video RAM 124, by generating row address and column address signals. After the address is latched and enabled, the GDC 120 outputs the video data via data bus 123 to the video RAM 124. In a similar fashion, to display the contents the video RAM 124, the GDC 120 latches the addresses and outputs the appropriate control signals; the graphics control logic enables the address latch by generating the row and column address enables; and the video data moves to the shift register 128 via data bus 126.

The graphics control logic 130 and the DOTCLK, via the CPU data bus 119, align the video data within the shift register 128 into a 4-bit address describing each pixel. The shift register 128 passes this 4-bit pixel into the palette RAM 132 via bus 133. The palette RAM 132 uses this 4-bit address to select an 8-bit pixel, to create a higher resolution color, consisting of 2 red bits, 2 green bits, 2 blue bits, and 2 intensity bits. The 8-bit pixel passes via bus 135 to a D/A signal driver 136 that converts each 2-bit digital signal into an analog video signals. In total, the D/A signal driver 136 outputs 4 analog signal, i.e., a red, green, blue and intensity, and with the appropriate sync signals, generates the video display on the respective overhead CRT 2, via CRT bus 3.

Figure 5A:
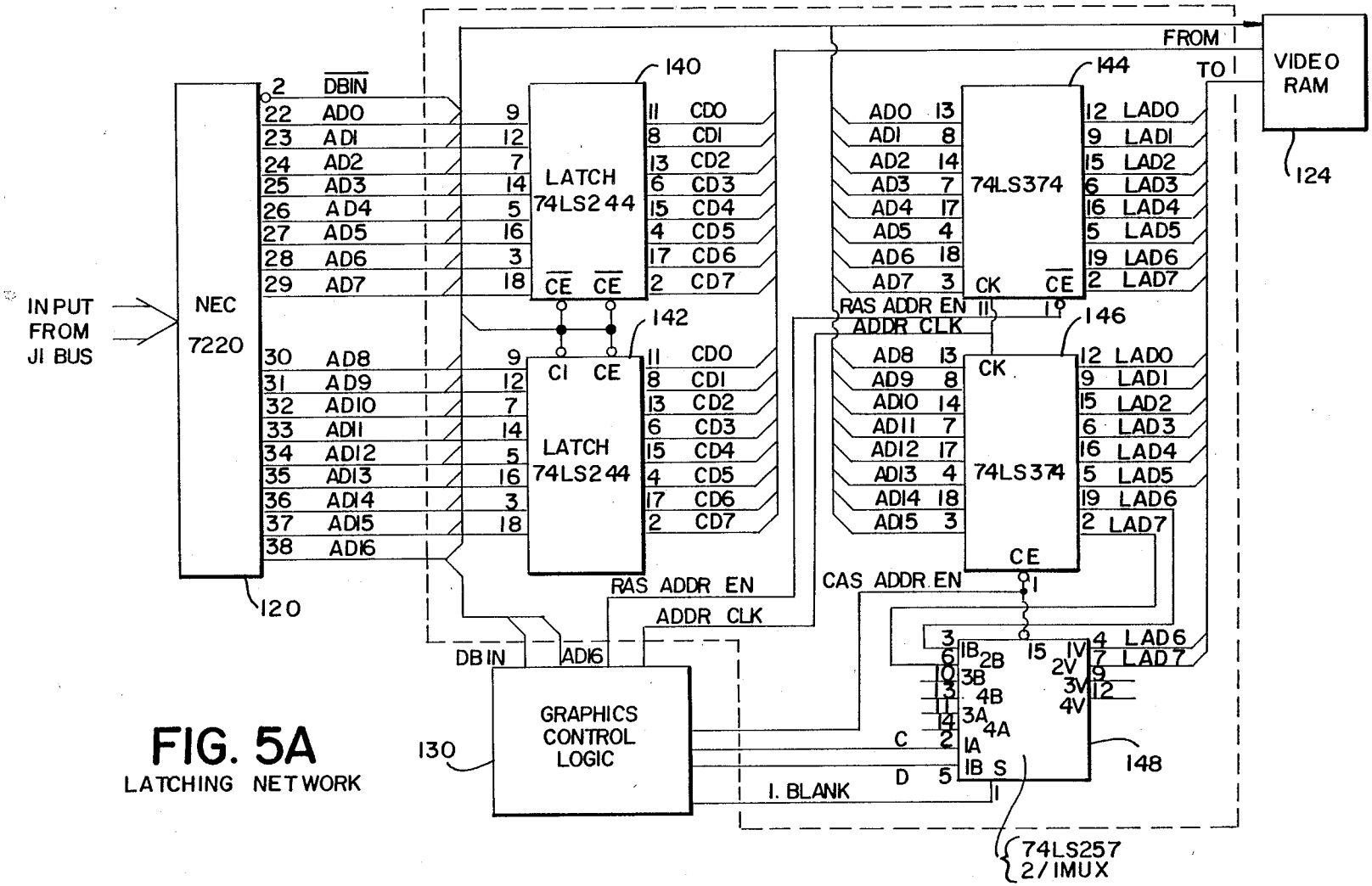
FIG. 5A illustrates a detailed diagram of the latching network 122 of the graphics controller board 50.
Figure 5B:
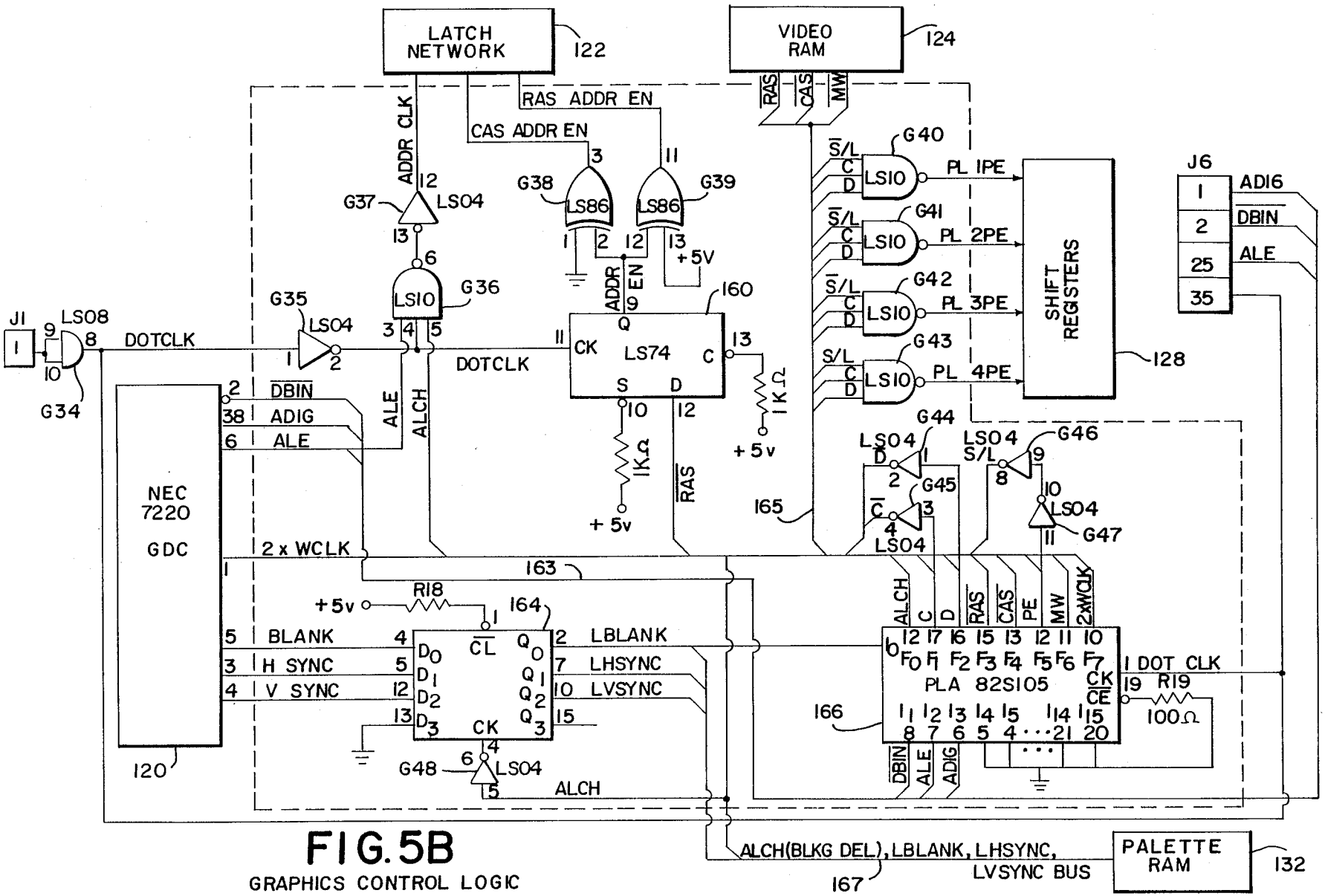
FIG. 5B illustrates a detailed diagram of the graphics control logic 130 of the graphics controller board 50.

FIG. 5A illustrates the data and address latching network 122 on the GDC board 50. When the GDC 120 reads data from the video RAM 124, typically during a read-modify-write cycle, it latches that 16 -bit data into a pair of LS 244 noninverted 3-state outputs. The low order byte is coupled from the video RAM 124 into latch 140 at CD0(11), CD1(8), C2(13), CD3(6), CD4(15), CD5(4), CD6(7), CD7(2) and output from pins 9, 12, 7, 14, 5, 16, 3 and 18 into the GDC 120 AD0(22), AD1(23) . . . AD7(20). Similarly, the high order byte is coupled from the video RAM 124 into latch 142 as illustrated and outputs into the GDC 120 at AD8(30), AD9(31) . . . AD15(37). The DBIN(21) active low enable input the chip enables on both latches. When the GDC 120 writes data to the video RAM 124, again during a read-modify-write cycle, it latches that 16-bit address into a pair of LS 374 octal D-type transparent latches. The low order byte is input into latch 144 at AD0(13), AD1(8), AD2(14), AD3(7), AD4(17), AD5(4), AD6(18), AD7(3), and the output is coupled from LAD0(12), LAD1(9), LAD2(15), LAD3(6), LAD4(16), LAD5(5), LAD6(19), LAD7(2) into the video RAM 124. The low order byte constitutes the row addresses in the video RAM 124. The row address enable (RAE), issued by the graphics control logic 130, active low enables the low order address latch 144. Similarly, the GDC 120 inputs the high order byte into latch 146 and the output is coupled from LAD0(12), LAD1(9) . . . LAD7(2). The first 6 address lines, LAD0(12)—LAD5(5), output to the video RAM 124. The last 2 address lines, LAD6(19) and LAD7(2), input into LS 257, a 2/1 multiplexer (MUX) 148, into 1B(3) and 2B(6), and the graphics control logic 130 outputs control signals C and D, video channel selector bits that select one of four video channels, into 1A(2) and 2A(5) of the MUX 148. The graphics control logic 130 also inputs LBLANK, the left CRT blanking output, into the select input S(1) of the MUX 148. If LBLANK equals 1(high), then the MUX 148 outputs LAD6 and LAD7 out of 1V(4) and 2V(7) into the video RAM 124. If LBLANK equals 0(low), then the MUX 148 outputs C and D out of IV(4) and 2V(7) into the video RAM 124. The C and D signals are used to shift out video dots or for loading new information into the video RAM 124, while LAD6 and LAD7 complete the standard 16-bit address scheme A14 and A15. The high order byte constitutes the column address in the video RAM 124. The column address enable, issued by the graphics control logic 130, active low enables the high order address latch 146 and the MUX 148. The address clock, issued by the graphic control logic 130, clocks the latch 144 and latch 146 to synchronize the address scheme.

FIG. **5*b* illustrates the graphics control logic 130 on the GDC board 50. The graphics control logic 130 controls the timing and access interplay between the GDC 120 and the latching network 122, video RAM 124, shift register 128 and the palette RAM 132. The GDC 120 passes the following control signals into the graphics control logic 130: data bus in (DBIN), address line 16 (AD16), address latch enable (ALE), a CRT blanking signal (BLANK), horizontal sync (HSYNC), and vertical sync (VSYNC). The graphics control logic 130 generates the following suitable control signals: address clock (ADDR CLK), column address select address enable (CAS ADDR EN) and row address select address enable (RAS ADDR EN), all of which are coupled to the latch network 122. Row address select (RAS), column address select (CAS) and memory write (MW) signals are coupled to the video RAM 124. Palette 1 through 4 parallel enable signals (PL1PE, PL2PE, PL3PE and PL4PE) are coupled to the shift register 128. The address load clock high (ALCH), left blank signal (LBLANK), left horizontal sync (LHSYNC) and left vertical sync (LVSYNC) signals are coupled into the palette RAM 132**.

The graphics control logic 130 consists primarily of a programmable logic array (PLA) 166, a PLA 82S105 chip device, with suitable, accompanying latches and combination logic. The GDC 120 passes DBIN, AD16 and ALE signals along bus 163 into the PLA 166. DBIN(2) signals passes into I1(8) ALE(6) signals passes into I2(7), and AD1G(38) passes into I3(6). The GDC 120 passes BLANK(5) signals to a D-type flip 164 at DO(4). A five volt signal passing through resistor R18 into CL(1) disables the clear function. Since all the flip flops in the PLA 130 are unconditionally preset to "1" during power turn on, the ALCH signal from F0(12) of PLA 166 goes high. When the PLA 166 generates an ALCH low signal, the ALCH signal passes into an LS04 inverter G48 at pin 5 and out from G48 at pin 6. The inverter G48 inverts the low signal to a high signal and is coupled into clock latch 164 at CL(4). Latch 164 passes LBLANK signal at pin Q0(2) into input 10(9) of the PLA 166. The I4(5), I5(4) . . . I15(20) terminals of PLA 166 are tied to ground. The chip enable (CE) at pin 19 is grounded through a 100 OHM resistor R19 to low enable the PLA 166. The J1 bus, see FIG. **5*b*, passes the DOTCLK signal into pins 9 and pin 10 of a LS 08 AND gate G34 to provide a time delay on the DOTCLK signal. The DOTCLK signal on output pin 8** of G34 clocks the PLA166 by coupling into CK(1).

In total, the PLA 130 receives DBIN, ALE, AD16 and LBLANK as inputs and on every DOTCLK signal generates ALCH at pin OF(18), video channel select bits (C and D) at pin F1(17) and F2(16), RAS at pin F3(15), CAS at pin F4(13), parallel enable (PE) at pin F5(12), MW at pin F6(11) and 2XWCLK at pin F7(10).

The graphics control logic 130 produces the ADDR CLK signal as follows. The GDC 120 pass ALE(6) to an LS10 NAND gate G36 at pin 3. The output signal at pin 8 of G34 passes into the inverter gate G35 at pin 1. The inverted DOTCLK signal passes from pin 2 of G35 to pin 4 of NAND gate G36. The ALCH signal passes from the PLA166 at pin OF(18) to pin 5 of G36. The output of G36 at pin 6 pass into the inverter gate G37 at pin 13. The output of G37 at pin 12 represents the ADDR CLK signal that passes into the latch network 122. When the DOTCLK clocks the PLA 166, if ALCH is high and ALE is high, then the ADDR CLK goes high into the latch network 122.

The graphics control logic 130 produces the CAS ADDR EN and RAS ADDR EN signals as follows. The DOTCLK signal output from pin 2 of inverter gate G35 clocks a 74LS74-D-type flip flop 160 at CK(11). The RAS signal passes from the PLA 166 at pin F3(15) to pin D12 of flip flop 160. Five volts coupled by way of 1000 OHM resistor R15 disables the clear function at pin C(13). And five volts passes through a 1000 OHM resistor R16 disabling the set function at pin S(10). The Q(9) output signal pass from the flip flop 160 into a pair of LS86 exclusive-OR gates at pin 2 of G38 and at pin 12 of G39. The other input at pin 1 of G38 is tied to ground. And the other input a pin 13 of G39 is tied to five volts. Pin 3 of G38 passes CAS ADDR EN to the latch network 122. And pin 11 of G39 passes RAS ADDR EN to the latch network 122. G38 and G39 assure that RAS ADDR EN and CAS ADDR EN assume opposing address enabling values.

The graphics control logic 130 produces the RAS, CAS and MW signals at pins F3(15), F4(13) and F6(11) of PLA 166. These signals are passed along bus 165 to the video RAM 124. RAS and CAS are the address strobes which are necessary to access the dynamic video RAM 124. As described infra, the low order and high order addresses are multiplexed onto pins of the video RAMs. Internally, the RAM is organized into a matrix of memory locations arranged into rows and columns. Thus a memory location is addressed by presenting a ROW address and a RAS strobe, followed by a column address and CAS. The MW strobe signals the RAM to store the data presented.

The graphics control logic 130 produces the write clock signal 2XWCLK, generated from the PLA 166 at pin F7(10) and passed along line 167 to the GDC 120 at pin 2XWCLK(1). This signal cycles at two times the rate of the memory write (MW) strobe, which allows the synchronous timing of the circuitry involved in video generation and memory updating.

The graphics control logic 130 produces the PL1PE, PL2PE, PL3PE and PL4PE signals. These signals control whether the video shift registers are loading new information from the RAMs, or shifting that information out to the video display generation circuitry, as will be discussed in more detail infra.

The PLA 166 generates C, D and PE signals. C and D are video channel select bits that select one of four video channels, namely CH1, CH2, CH3, or CH4 for shifting out video DOT or loading new information from the RAMs. PE controls whether loading or shifting occurs. PE passes from the PLA 166 through a pair of LS04 inverters G47 and G46 needed for timing delay. Pin F5(12) of the PLA 166 passes to pin 11 of G47. Output pin 10 of G47 passes to pin 9 of G46. Output pin 8 of G46 passes along bus 165 to each of the 4 NAND gate G40, G41, G42 and G43. C passes from pin F1(17) of PLA 166 to an LS04 inverter G45 in pin 3 and out pin 4. D passes from pin F2(16) of the PLA 166 to an LS04 inverter G44 and out from pin 2 thereof. C also passes along bus 165 to NAND gates G40 and G42. D also passes along bus 165 to NAND gates G41 and G42. The inverted C signal at pin 4 of G45 passes along bus 165 to gates G41 and G43. The inverted D signal of pin 2 of G44 passes along bus 165 to gates G40 and G42. This combination logic generates a mutually exclusive parallel load signal FRJM one of the four gates.

The graphics control logic 130 produces the ALCH (BLKG DEL), LBLANK, LHSYNC and LVSYNC signals as follows. The LBLANK signal allows GDC 120 to blank the CRT screen. The HSYNC and VSYNC signals allow the GDC120 to control the sychronization of the video signals. The ALCH strobe synchronizes the changing of addresses on the video RAMs with the rest of the video generation timing to minimize disturbances on the CRT screen. The GDC 120 passes BLANK (5), HSYNC(3) and VSYNC(4) to D0(4), D1(5) and D2(12) of data latch 164. INPUT D3(13) of data latch 164 is grounded. Q3(15) is unused. Five volts is coupled through a resistor R18 into CL(1) to disable the clear function. ALCH pass from pin F0(12) of the PLA 166 to an LS04 inverter gate G48 at pin 5. The output of the inverter gate G48 at pin 6 pass to the CK(4) of data latch 164. When ALCH is low, the data latch 164 pass LBLANK at pin Q0(2), LHSYNC at pin Q1(7) and LVSYNC at pin Q2(10) along bus 167 to the palette RAM 132 ALCH also passes along bus 167 to the palette RAM 132.

Figure 5C:
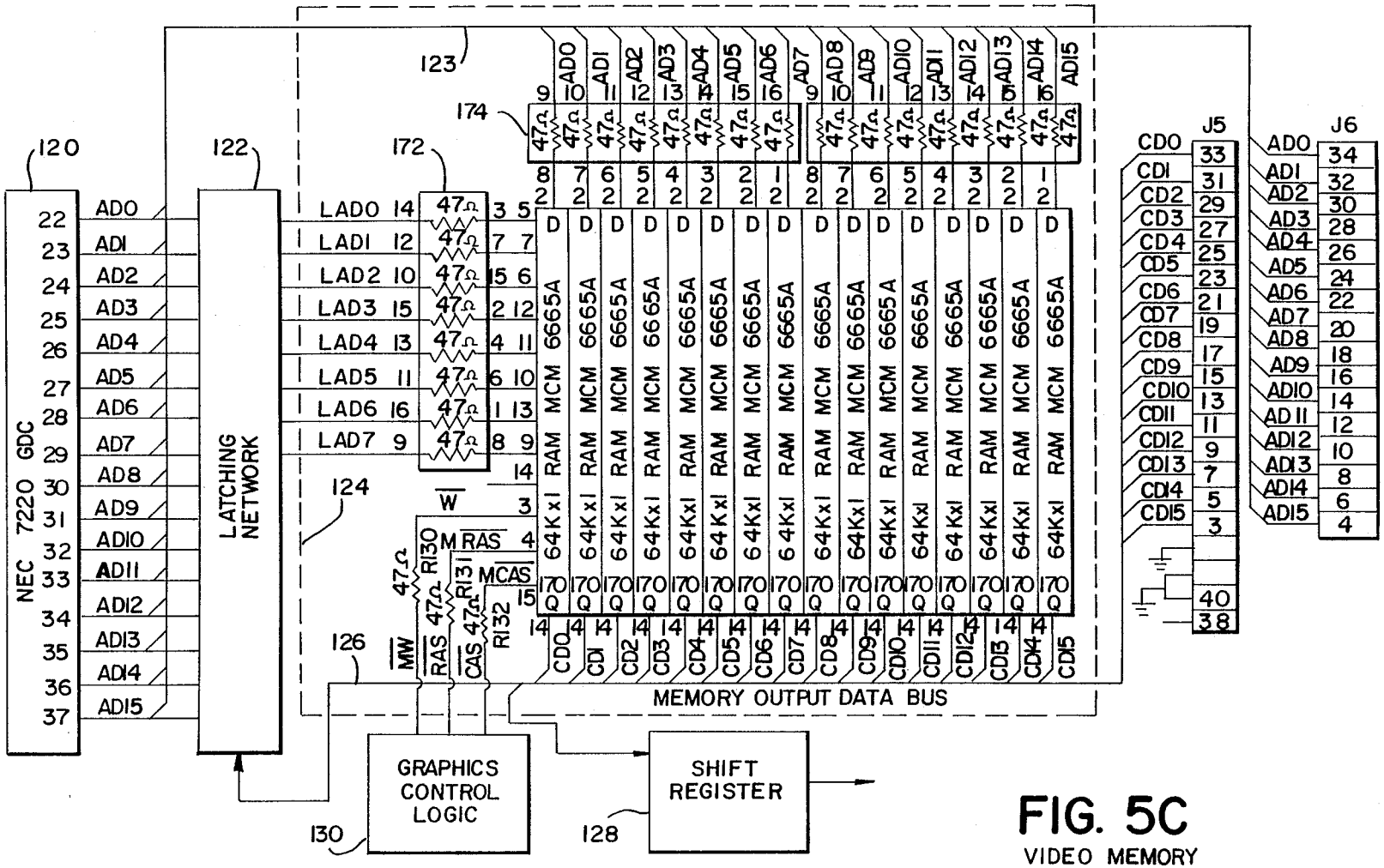
FIG. 5C illustrates a detailed diagram of the video memory 124 of the graphics controller board 50.

FIG. 5C illustrates the video RAM 124 on the GDC board 50. As previously described in FIG. 5A, row address lines and column address lines AD0—AD15 from GDC 120 are latched in the latching network 122, are channelled to the video RAM 124 on lines LAD0 through LAD7. These address lines each pass through a 47 ohm resistor, then into pins 5, 7, 6, 12, 11, 10, 13, and 9 of each RAM memory chip 170. The RAM memory comprises 16 MCM 6664A chips, each with a 64K by 1-bit architecture. To write data into the RAM, the GDC 120 passes data along bus 123 into AD0(22), AD1(23) . . . AD15(37) into respective 47 ohm resistor, encased in two 8 resistor IC's 174. AD0, AD1, AD2, . . . AD15 input into D(2) of the respective MCM 6665A chip. To read data from the RAM, the Q(14) output pass 6-bits of data CD0—CD15 along bus 126 into the latching network 122, as previously described, or into shift register 128 for video display. During both read and write functions, the graphics control logic 130 couples RAS and CAS signals through a 47 ohm resistor, R131 and R132, and into the memory row address signal (MRAS) and memory column address signal (MCAS) at pin 4 and pin 15, respectively, of each MCM 6665A chip. In addition, the graphic control logic 130 signals read/write controls in memory write through a 47 ohm resistor R130 and into W(3) of each MCM 6665A. Both the data read into the RAM block and written from the RAM pass onto the GDC bus 49, J5 and J6.

Figure 5D:
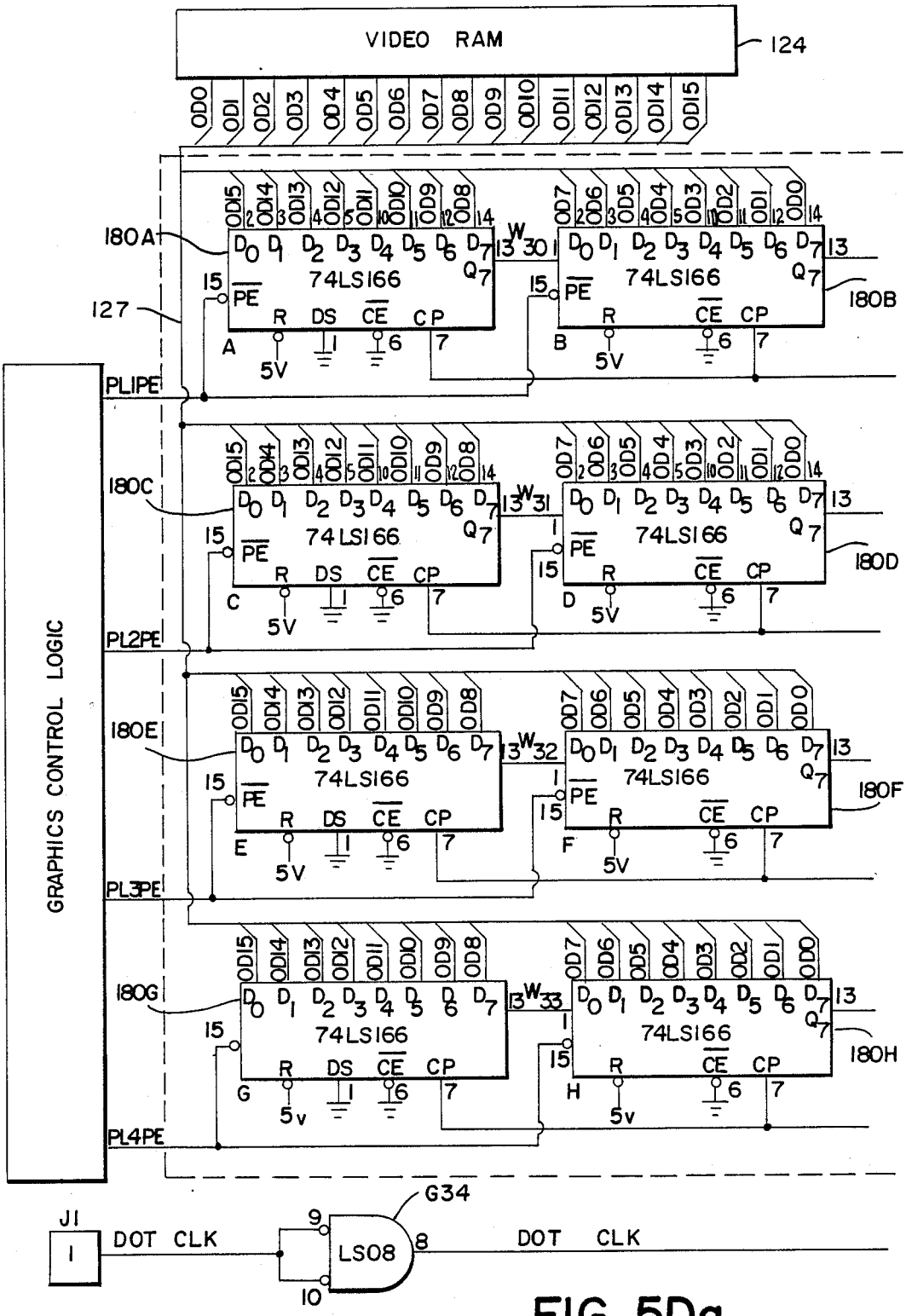
FIG. 5D illustrated a detailed diagram of the shift register 128 of the graphics controller board 50.
Figure 5D:
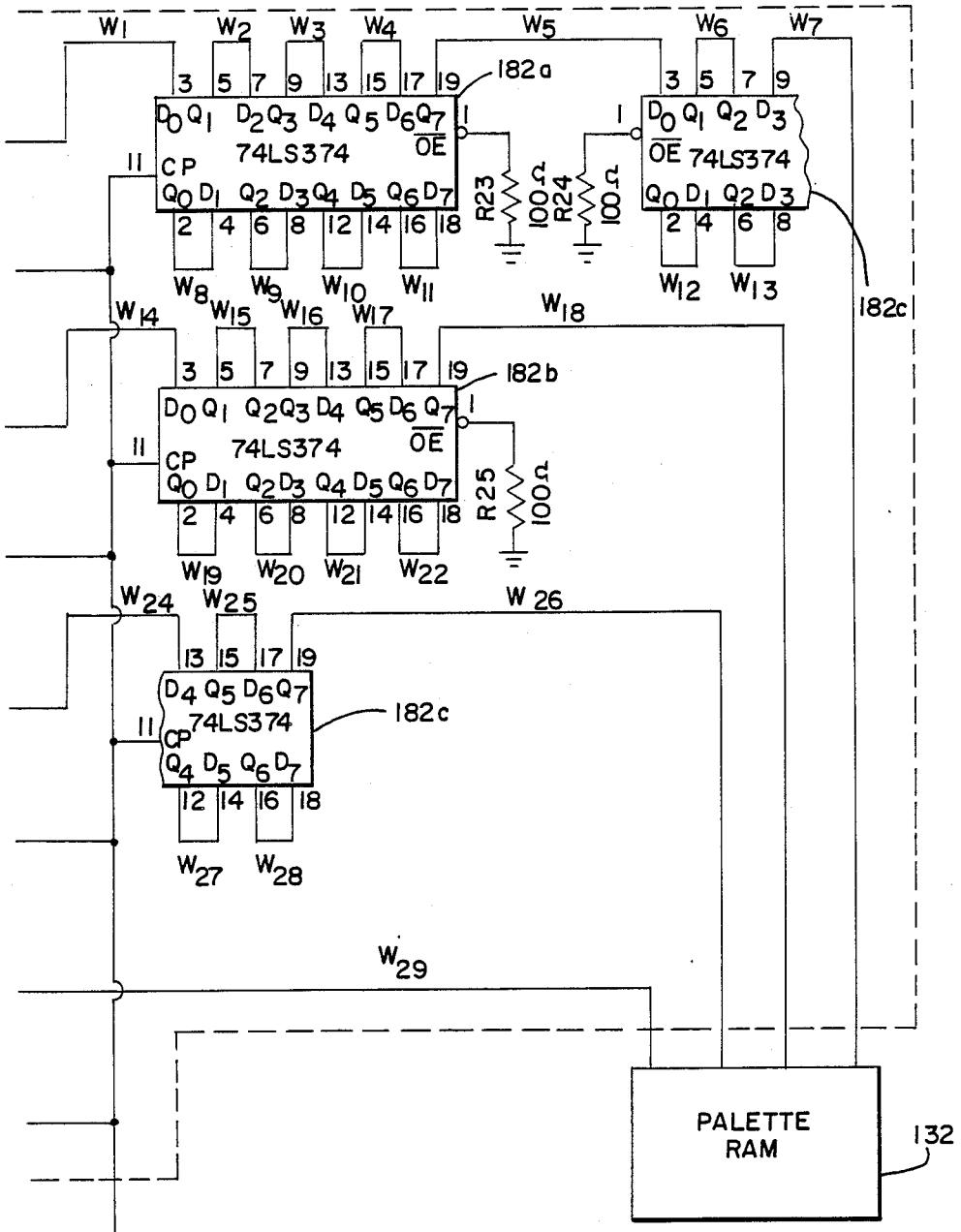

FIG. 5D illustrates the shift register network 128 on the GDC 120. The network 128 consists of 4 independent video channels. Each channel includes two 8-bit shift registers CH1:SR 180A B; CH2:SR 180C D; CH3: SR 180E F; and CH4:SR 180G H. To load a channel with 16-bits of data from the video RAM 124, the graphics control logic 130 active low enables one of the channels, either PL1PE (CH1), PL2PE (CH2), PL3PE (CH3), or PL4PE (CH4) through respective input terminals PE(15) on the SR devices. As previously described in FIG. 5C, the video RAM 124 channels 16-bits of data long bus 126 into the SR as follows. High order byte -OD15 into D0(2), OD14 into D1(3) . . . , and OD8 into D7(14). Low order byte -OD7 into DO(2), OD6 into (D1(3) . . . ODO into 1D7(14). On all 8 SRs, a five volt signal disables the clear function at R(9), and the grounding of CE(6) active low enables each SR. On the 4 high order by byte SRs, 180A, 180C, 180E and 180G, the grounding of DS(1) disables the serial data input. The DOTCLK simultaneously clocks the SRs at CP(7) effectively to complete the loading of the 16-bits of video data.

To maximize data throughput in the shift register network 128, the respective channels are aligned so that a time division multiplexing scheme becomes possible. To accomplish this scheme, additional bits are appended onto each channel by adding LS 374 D-type transparent latches. The additional bits appended on each channel are as follows: CH1—12-bits, CH2—8-bits, CH3—4bits. As is well known in the digital electronics art, the additional bits offset each channel to maximize throughput by minimizing the re-loading time accummulatively on the four channels. Instead of serially loading each channel, shifting out the four channels in parallel to the palette RAM 132 and serially re-loading each channel, the shift register network 128, initially, serially loads and aligns each channels, shifts out the four channels in parallel to the palette RAM 132, while effectively re-loading the next empty shift register per channel every four bits shifted to the palette RAM 132.

To accomplish this alignment, see FIG. 5D b, data latch 182*a* and data latch 182*c* (via connection W5) are appended to the CH1 channel, data latch 182*b* is appended to the CH2 channel, and a portion of data latch 182*c* is appended to the CH3 channel. The CH4 channel needs no extra bits in this scheme. Note that the CH1 and CH3 share data latch 182*c* 4-bits each. To shift a channel of 16-bits, Q7(13) of the high order byte outputs to the serial data input DS(1) of the low order byte along lines W30, W31, W32, and W33 on the respective four channels. Q7(13) of the low order byte outputs along line W1(CH1), W14(CH2), W24(CH3) and DO(3) of data latch 182*a*(CH1), 182*b*(CH2) and D4(13) of data latch 182*c*(CH3). On the CH1 the data shifts on latch 182*a* as follows: DO(3) internally latches to Q0(2); Q0(2) inputs along line W8 to D1(4); D1(4) internally latches to Q1(5); Q1(5) inputs along line W2 to D2(7); . . . ; finally, D7(18) internally latches to Q7(19) outputs along line W5 to D0(3) of latch 182(*c*). The data shifts similarly into the other LS 374 latches. The OE(1) of the respective latches are each active low enable by grounding resistors R23, R24, and R25 respectively. The DOTCLK connected to CP(7) of the shift registers and CP(11) of the data latches simultaneously shifts each channel, thereby outputing in parallel lines W7(CH1), W18(CH2), W26(CH3), and W29(CH4) into the palette RAM 132.

Figure 5E:
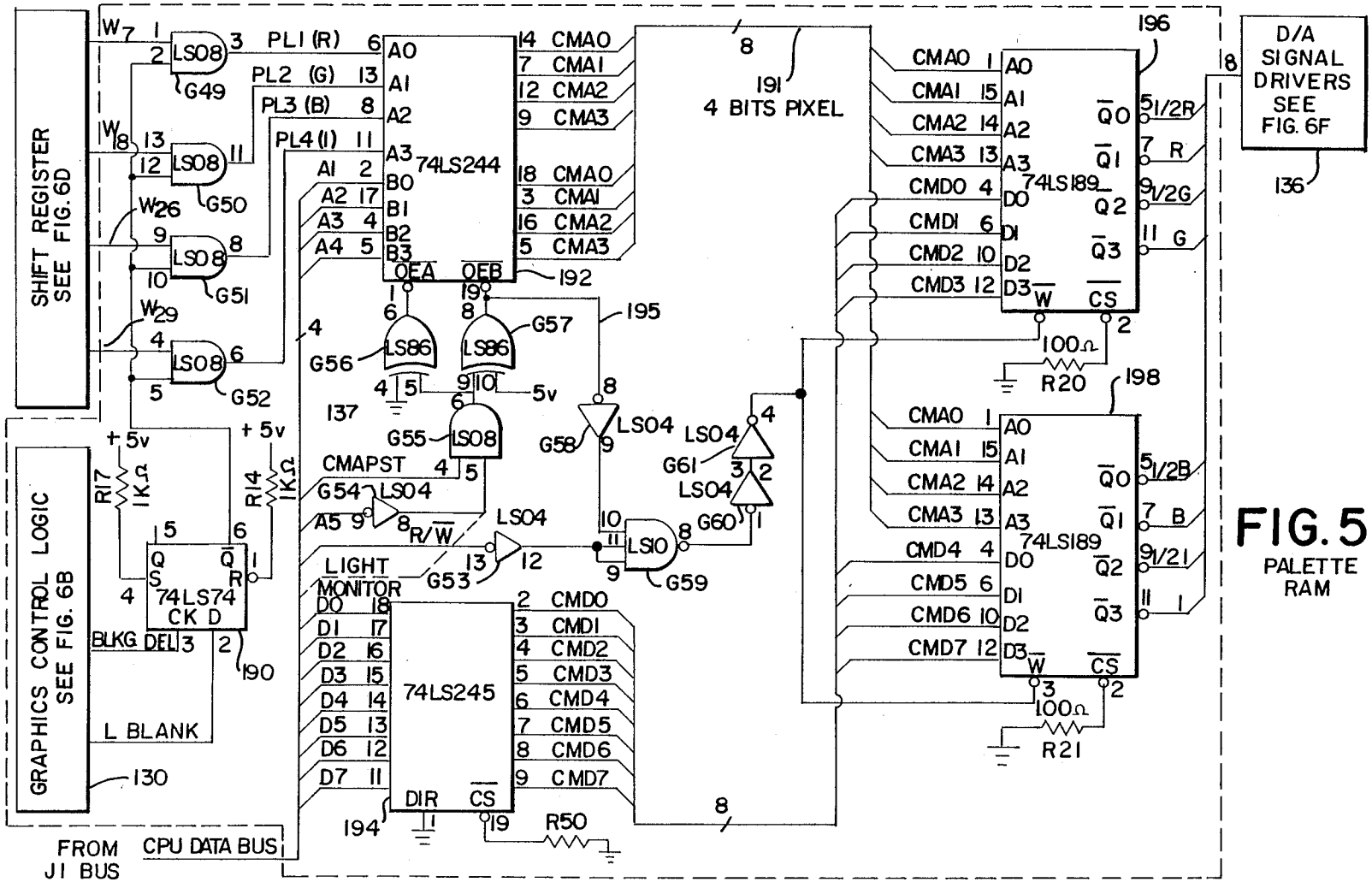
FIG. 5E illustrates a detailed diagram of the palette RAM 132 of the graphics controller board 50.

FIG. 5E illustrates the palette RAM 132 on the GDC board 50. The palette RAM 132 consists of a means to expand a 4-bit pixel to an 8-bit pixel to attain higher resolution color graphics and a means to change the subset of colors contained in the palette RAM to attain a more diversified range of coloration of the CRT display. In general, to expand the 4-bit pixel to an 8-bit pixel, a 4-bit pixel is buffered, then the buffered 4-bits address a pair of palette RAMs. One of the two palette RAMs contains 16 combinations of 4-bits that expand the CH1 and CH2 signals to CH1, ½ CH1, CH2 and ½ CH2. The other palette RAM expands the CH3 and CH4 signals to CH3, ½ CH3, CH4, ½ CH4. The pair of palette RAMs generate an 8-bit pixel, channelled to the D/A signal driver 136. In general, to change the subset of colors available in the palette RAM, a 4-bit address is buffered, an appropriate 8-bit color set is buffered, then the buffered 4-bits address the pair of palette RAMs, thereby writing the 8-bits into the pair of palette RAMs. After performing the above sequence for each of the 16 addresses, the palette RAMs will subsequently contain 16 combinations of color with 8-bits of color resolution.

The expansion of the 4-bit pixel to an 8-bit pixel is implemented as follows. The shift register 128 channels the 4-bit pixel along W7, W18, W26 and W29 into AND gates G49, G50, G51 and G52 at pins 1, 13, 9, and 4 respectively. The graphic control logic 130 channels the blanking delay signal (BLKGDEL) and the left blank signal (LBLANK) into a 74LS74 D-type flip flop 190. The BLKGDEL signal clocks the flip flop at the CK input, pin 3; and the LBLANK signal triggers the D input at pin 2. A five volt signal passing through a 1000 OHM resistor (R17) disables the preset function(s) at pin 4. A five volt signal passing through a 1000 OHM resistor R(14) disables the clear function (R) at pin 1. The Q output at pin 5 is left open. When BLKGDEL goes high and clocks the flip flop 190, the flip flop 190 produces the LSBLANK signal from Q at pin 6. When LBLANK is low the 4-bit pixel passes into the AND gates and out of pins 3, 11, 8, 6. The 4-bit pixel passes into channel A of the 74 LS 244 octal buffer 192 at A0(6), A1(13), A2(8), and A3(11).

The J1 bus, see FIG. 5, channels the color map strobe (CMAPST) and address line 5(A5) signals along the CPU data bus 137. Signal A5 passes into an LS04 inverter G54 at pin 9, out of inverter G54 at pin 8, and into an LS08 AND gate G55 at pin 5. CMAPST passes into G55 at pin 4. The G55 output at pin 6 passes into LS86 an exclusive OR gate G56 at pin 5. Pin 4 of G56 is grounded. The output of gate 56 at pin 6 low enables the octal buffer 192 at output enable channel A(OEA) at pin 1. When CMAPST goes high and A5 goes low, the octal bus 192 channels the 4-bit pixel to the pair of palette RAMs as follows: First, G54 inverts A5 to the high state; second, CMAPST (high) and A5(high) produce a high signal at G55 which passes to G56 at pin 5; third, a high signal at pin 5 and a ground signal 4 of G56 produce a low enabling signal.

The 4-bit pixel passes from the octal buffer 192 and address a pair of palette RAMs 196 and 198. The 4-bit pixel passes from CMA0(14), CMA1(7), CMA2(12), and CMA3(9) of the octal buffer to each palette RAM at A0(1), A1(15), A2(14) and A3(13) respectively along bus 191. Chip select (CS) at pin 2 pass through a 100 OHM resistor R20 to ground on each RAM 196 and 198, thereby holding the chip select low and selecting RAM 196 and 198. The pair of palette RAMS generate an 8-bit pixel, as a function of the 4-bit pixel address, and channel the 8-bit pixel to the D/A signal driver 136. Q0(5), Q1(7), Q2(9), and Q3(16) of each palette RAM 196 and 198 produce the ½ R, R, ½ G, G, ½ B, B, ½ I, I 8-bit pixel.

The changing of the color set contained in the palette RAM is implemented as follows. The J1 bus, see FIG. 5, channels the 4 address bits (A0, A1, A2 and A3) along the CPU data bus 137 A0, A1, A2 and A3 pass into channel B of the octal buffer 192 at B0(2), B1(17), B2(4) and B3(5). Consistent with that previously described, CMAPST and A5 combine to low enable the octal buffer 192 at the output enable channel B (OEB) at pin 19. The output of AND gate G55 pass to a pair of LS86 exclusive-OR gate G56 and G57. The input of G56 at pin 4 is grounded, the input of G57 at pin 10 is held at five volts and the output of G55 at pin 6 pass to both G56 and G57. This logic combination enable channel A or B alternatively. When CMAPST goes low or A5 goes high, the octal bus 192 channels the 4 address bits to the pair of palette RAMs, similar to that previously described. The 4 address bits pass from the octal buffer 192 and address a pair of RAMs 196 and 198. The 4 address bits pass from CMA0(18), CMA1(3), CMA2(16) and CMA3(9) of the octal buffer to each palette RAM at A0(1), A1(15), A2(14) and A3(13) respectively along bus 191.

The J1 bus, see FIG. 5, also channels 8 data bits (D0, D1, . . . D2) along the CPU data bus 137. D0, D1 . . . D7 pass into an 74LS245 octal buffer 194 at B1(18), B2(17) . . . B8(11). The J1 bus also channels the read/write signal R/W. The R/W signal passes through a LS04 inverter G53 into pin 13 and out from pin 12. From G53 at pin 12 the inverted signal passes to an LS10 NAND gate G59 at pin 9 and pin 11. As previously discussed, the low enable signal passed from G57(8) to OEB(19) on the octal buffer 192 and passes along line 195 to an LS04 inverter gate G58. The signal passes into G58 at pin 8 and out from G58 at pin 9. From G58 at pin 9 the inverted signal passes to NAND gate G59 at pin 10. The output signal of NAND gate G59 at pin 8 through a two LS04 onverters G60 and G61 to low enable W at pin 3 of each palette RAM.

When CMAPST is low or A5 is high, G57 low enables channel B and passes the 4 address bits. The G57 low enable signal is inverted to a high signal by G58 and passed into NAND gate G59. Gate 53 inverts a low write signal to a high signal and passes that signal to NAND gate G59. Three high input to G59 produces a low output. This low output at G59 from pin 8 pass through two inverts to achieve timing delay and low enables the active low write enable at pin 3 of each palette RAM. The pair of palette RAMs subsequently contains the 8-bit color set at the address location of A0, A1, A2 and A3.

FIG. 5*f* illustrates the D/A signal driver logic 136 on the GDC board 50. The D/A signal driver logic 136 converts an 8-bit digital signal into four separate analog video graphics signals. The four video graphics signals and the two synchronization signals combine to drive the CRT.

The 8-bit pixel of video data is coupled from the palette video RAM 132 to a data latch 200. The latched 8-bit pixel is coupled to the respective current drivers 202, 204, 206, and 208. The left horizontal sync signal (LHSYNC) and right horizontal sync signals (RHSYNC) are coupled from the graphics control logic 130 to the D/A signal drive logic 136. Each of the current drivers 202–210 generate a respective video graphics signal for red, green, blue, intensity, LHSYNC and LVSYNC. For red, green, blue and intensity, the 2 bits of 8 bit video data signal produce one of four possible analog voltage levels. For LHSYNC and LVSYNC, the 1 bit of digital resolution produces one of two possible digital levels. These 4 analog signals and 2 digital combine to drive the CRT display.

The 8-bits of data couples from the palette RAM 132 into a 74LS374 D-type flip flop latch 200 on pins 1D(3), 2D(4), 3D(7), 4D(8), 5D(13), 6D(14), 7D(17), 8D(18). When the DOTCLK from J1 bus, see FIG. 5, clocks the latch 200 at pin CK(11), the 8-bit data signal is latched. The 8-bits of data pass out from latch 200 at 1Q(2), 2Q(5), 3Q(6), 4Q(9), 5Q(12), 6Q(15), 7Q(16) and 8Q(19) and two respective bits of that 8 bit signal are coupled into each of the current drivers 202, 204, 206 and 208. Signals 1/2 R and R pass into driver 206, signals 1/2 G and G pass into drive 202, signals 1/2 B and B pass into driver 204, and signal 1/2 I and I pass into driver 208, each signal passes into 1A at pin 5 and 2A at pin 11 of the four signal drivers respectively. For all four signals drives, a five volt signal enables 1B(6), 1C(7), CC(9) and BC(10) which are internal functions unused by the present system.

The respective signal drivers have two independent channels in 1YA, 1YB. The 1YA and 1YB lines are tied together because the driver generates the signal out of either input. The combined signal from 1YA and 1YB is passed through a resistor thereby to convert the digital signal to an analog signal. In a similar fashion, the 2YA and 1YB lines are tied together. The combined signal from 2YA and 2YLB is passed through a resistor to change the digital signal to an analog signal. Points a, b, c, d tie the two respective outputs of each driver together, summing the two analog signals at each point. The combination of the current driver and resistors on each channel perform the digital to analog data conversion.

For the red channel, signals 1YA(4) and 1YB(3) of driver 206 pass the 1/2 R signal from the driver 206 to a 220 OHM resistor R151. Signals 2YA(12) and 2YB(13) pass the R signal from the driver 206 to a 120 OHM resistor R150. The analog signal from R151 and the analog signal from R150 are summed at point a and coupled to the left CRT at J3(2) or the right CRT at J4(2).

Similarly, for the green channel, signal 1YA(4) and 1YB(3) of driver 202 pass the 1/2 G signal from the driver 202 to a 220 OHM resistor 148. Signals 2YA(12) and 2YB(13) pass the G signal from the driver 202 to a 120 OHM resistor R149. The analog signal from R148 and the analog signal from R149 sum at point B and coupled to the left CRT at J3(3) or the right CRT at J4(3).

Similarly, for the blue channel, signals 1YA(4) and 1YB(3) of driver 204 pass the 1/2 B signal from the driver 204 to a 220 OHM resistor R152. Signals 2YA(12) and 2YB(13) pass the B signal from driver 204 to a 120 OHM resistor F153. The analog signal from R152 and the analog signal from R153 are summed at point C and coupled to the left CRT at J3(4) or the right CRT at J4(4).

For the intensity channel, signals 1YA(4) and 1YB(3) of driver 208 pass the 1/2 I signal from the driver 208 to a 280 OHM resistor R154. Signals 2YA(12) and 2YB(13) pass the I signal from driver 208 to a 120 OHM resistor R155. The signal from R154 and the signal from R155 are coupled to point D to the left CRT at J3(5) or the right CRT at J4(5).

For the horizontal and vertical synchronization signals, LHSYNC and LVSYNC pass from the graphic control logic 130 to driver 210 at pins 1A(5) and 2A(11) respectively. Signals 1YA(4) and 1YB(3) pass the LHSYNC signal from the driver 210 to a 75 OHM resistor R156. Signals 2YA(12) and 2YA(13) pass the LVSYNC signal from the driver 210 to a 75 OHM resistor R157. The analog signal from R156 passes to the left CRT at J3(6) or the right CRT at J4(6). The analog signal from R157 passes to the left CRT at J3(7) or the right CRT at J4(7).

Figure 6:
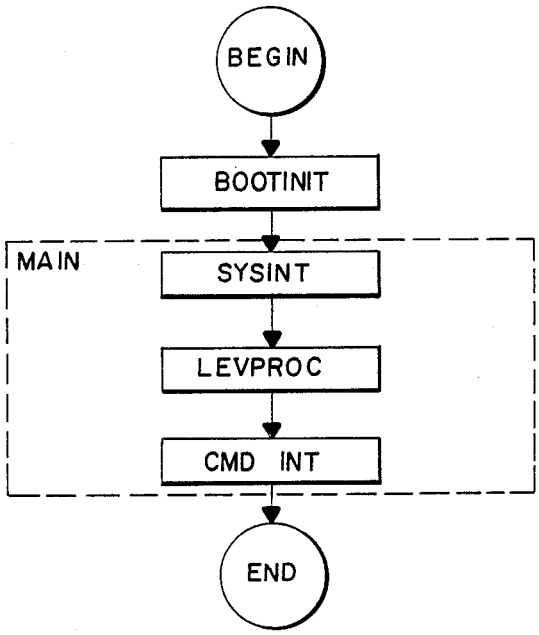
FIG. 6 illustrates a general flowchart of the software systems architecture.

FIG. 6 illustrates a flowchart of the overall software system architecture of the VGS. The architecture consists of the Bootinit, Sysinit, Levproc and Cmdinit programs. In the Bootinit program, the microprocessor 100 initializes the VGS RAM 104, see FIG. 4, from a cold start, when the manager turns on a bowling lane for a bowling game. In the Sysinit program, the microprocessor 100 initializes the hardware and software parameter of the VGS from a cold start and drives the VGS system by continually updating the video graphics display. In the Levproc program takes the left or right CRT display from the default display format of 6 bowlers and 10 frames, depending on bowler commands that indicate the present number of bowlers bowling on the left or right lane. In the Cmdinit program the microprocessor 100 processes the commands received from the data scorekeeping system and issues calls to the GDC main routine within the Sysint routine to display the current bowling gamescore information.

Figure 6A:
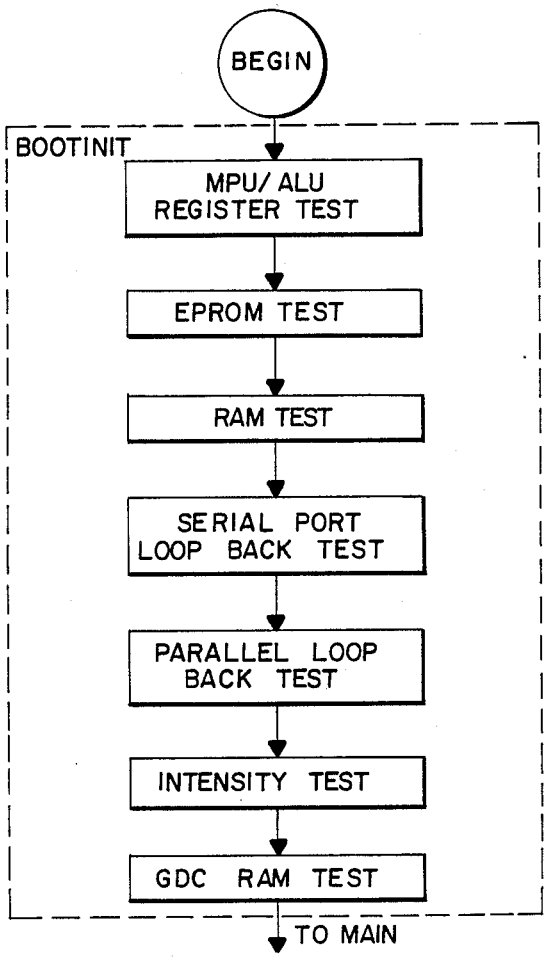

FIG. 6*a* illustrates a more detailed view of the Bootinit program. The MUP/ALU Register Test program tests and initializes the VGS microprocessor and arithmetic logic unit registers. The EPROM Test program tests the VGS EPROM 104, see FIG. 4. The RAM Test program tests the VGS RAM 104, see FIG. 4. The Serial Port Loop Back Test program tests the serial PIA network 110, see FIG. 4. The Parallel Loop Back Test program tests the parallel PIA 110, see FIG. 4. The Intensity Test program initializes and performs intensity tests on the GDC 100, see FIG. 5. The GDC RAM Test program initializes and performs tests on the RAM 124, see FIG. 5. Basically the GDC RAM test program initializes the GDC, performs RAM data tests by writing selected patterns to RAM 124, see FIG. 5, and reading that pattern from RAM, and performs address tests by writing a select pattern to RAM 124, and reading that pattern from RAM 124. The above test routines are standard hardware testing procedures well known in the microprocessor art.

Figure 6B:
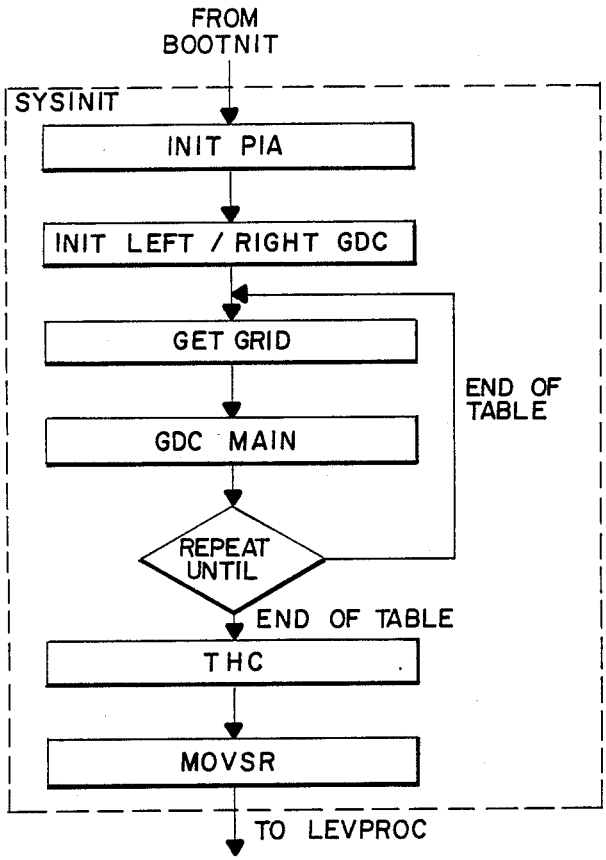

FIG. 6*b* illustrates a more detailed view of the Sysinit program. The Init PIA routine initializes the VGS PIA 110, see FIG. 4. Specifically, the ports and the timer. The Init Left/Right GDC routine initializes the video graphics display on the CRT by sending the appropriate video control, display control, drawing control and data read commands to the GDC 120, see FIG. 5. These command effectively blank the left or right CRT display. The new and present data character array and integer array buffer registers for the left and right CRT displays are cleared at the cold start. These buffer registers are locations within RAM/EPROM 104. The default score sheet grid format structure is set, usually for 6 bowlers in 10 frames. The left and right palette RAM 132, see FIG. 5, are loaded with default color combinations. Lastly, a score sheet grid is generated without bowler names on the CRT, awaiting the bowler names received from the bowler console.

At this point the VGS program enters the main driver loop. This loop consists of the GET GRID routine and the GDC Main routine. In the GET GRID routine the microprocessor 110 fetches a bowler grid from the grid format table in the video graphics data base in EPROM/RAM 104. The grid formats include 10 frame, 5 frame or tournament formats. Based on the format indicated for the selected GDC, the microprocessor 100 passes parameters of the grid format to the GDC Main routine. In the GDC Main routine, the microprocessor 100 generates the video graphics commands to the GDC 120 necessary to display the grid format on the CRT.

The GDC Main routine accepts the parameters passed from the Get Grid routine and issues video graphics commands to the left or right GDC 120, see FIG. 5, to execute these requests. The GDC Main routine examines the function code passed and calls the requested function by using a case function programming technique, explained in FIG. 7. The Get Grid and GDC Main routines execute in a loop until the end-of-table flag signals that the entire grid format table has been displayed on the CRT.

The Sysinit program then proceeds to the THC routine which displays the team handicap information, when necessary. The team handicap information is used in team bowling. The routine passes the parameters necessary to display the "TH" in the team handicap box of the score sheet grid, and a call to GDC Main to issue the video graphics command to the GDC 120.

In the Movsr routine the microprocessor 100 masks or enables the interrupts in the VGS, particularly the PIA 110, see FIG. 4. This allows the data scoring system to pass data to the VGS system such as bowler game score information from pinfall, scoring corrections, or bowler commands or manager commands to the VGS system, as will be explained in FIG. 6E.

Figure 6C:
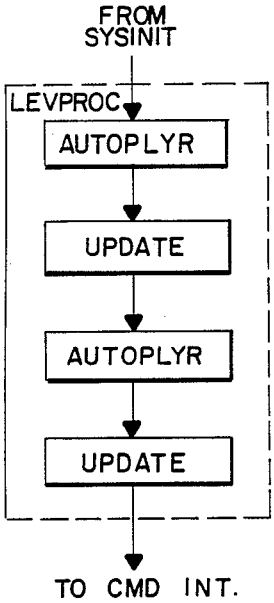

FIG. 6*c* illustrates the Levproc flowchart of the VGS software. When the overall system is turned on from a cold start, the system assumes the default video graphics format, generally set to 6 bowlers and 10 frames. The VGS displays the default format until either bowler commands or management commands entered at their respective consoles request a different format. The Autoplr routine calculates the number of bowlers on a give lane by checking the bowlers initials entered into the console keyboard to determine the number of players in the present game. Depending on this calculation, the Update routine will rebuild the screen, eliminating unused bowlers with appropriate grid format requests, see FIG. 8 for a detailed discussion of the Update routines. The Levproc routine performs the Autoplyr and Update routines for the left and right CRTs.

Figure 6D:
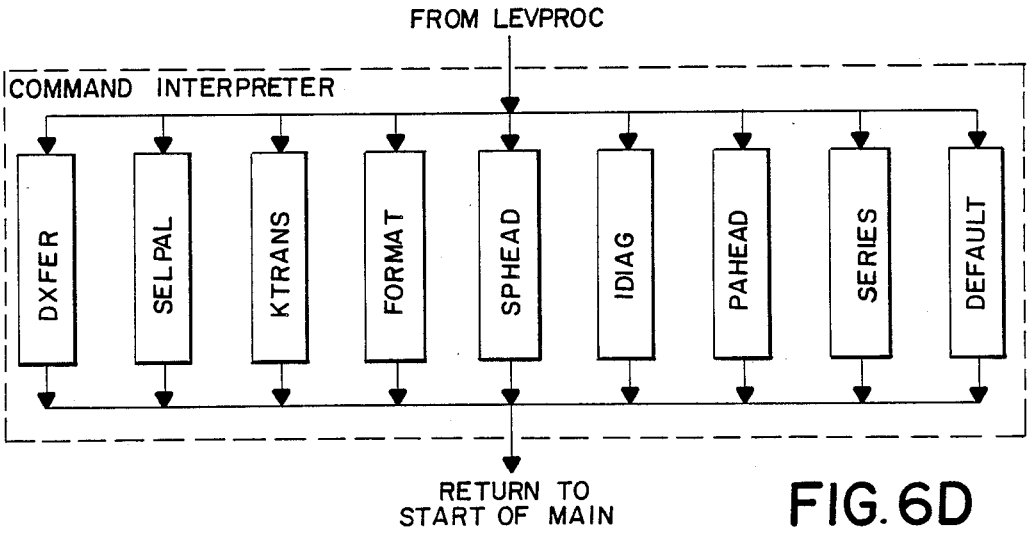

FIG. 6D illustrates the Command Interpreter flowchart. The Command Interpreter routine receives the following commands: data transfer (DXFER), select palette (SELPAL), keyboard transfer (KYTRANS), format (FORMAT), special heading (SPHEAD), initiate system diagnostics (IDIAG), pins ahead in tournament mode (PAHEAD), series total in tournament mode (SERIES), and default (DEFAULT). The routine uses a case function to direct the command to its proper function.

The DXFER routine transfers data from the data score board 44, see FIG. 4. See FIG. 8 for a detailed explanation.

The SELPAL routine loads the left, right or both palette RAMs 132, see FIG. 4, with a set of graphics colors. The microprocessor 100 accesses this color set in the EPROM/RAM 104, see FIG. 4. The EPROM/-RAM stores 8 sets of 16 color combinations that are indexed by an address pointer by addressing a particular location where that set resides. SELPAL then calls GDC Main which actually loads the set of colors into the respective palette RAM 132.

If the front desk terminal either wants to replace the 16 color subset with different 16 color subset, it may do so by issuing terminal desk commands. The VGS will receive that command through MGVGI/O routine, see FIG. 6*e*, and pass to GDC Main. In GDC Main, the case function PALNDX will load the color palette with 16 colors of a selected combination table.

The KTRANS routine accepts keyboard transfers as data into the VGS. The transfers include bowler and management commands with accompanying command data from the bowler terminal 26 and the manager terminal 28. The KTRANS routine receives this data from the MS_VGSIO interrupt routine.

The FORMAT routine selects one of three possible bowling score formats to display bowling game score information. The formats include five-frame, ten-frame, and tournament (see FIG. 15 and 16). The VGS uses a table-look technique that assigns a format address pointer to the format assigned to that CRT display. Each format resides in a distinct location in memory and consists of a set of video format characteristics that reflects that format. The set of video format characteristics include alpha-numeric characters and bowling score grid. FIGS. 10 through FIG. 16 illustrate the video graphic characteristics, and FIG. 9 explains the routine in more detail.

The SPHEAD routine displays a special heading as directed by the front desk terminal 28, FIG. 1. The manager initiates a message with accompanying command and the VGS displays that message on the particular bowling lane at the desired position on the CRT using the video format characteristic of that CRT.

The PAHEAD displays the pins ahead when in the tournament mode. The routine operates similar to the SPHEAD routine above.

The SERIES routine displays the series total in the tournament mode. The routine displays an individual series total and writes "SERIES" on the screen.

The DEFAULT routine returns the case function to the main executive routine, see FIG. 6.

FIG. 6E illustrates the interrupt Service Routine flowchart consisting of the Timers routine and the MS_VGSIO routine. The Timers routine is an interrupt service routine used to determine when to exit from Exception Processing routine. If the timer goes to zero after decrementing, a flag is set so the GDC Main routine will take the program out of the Interrupt Service routine and return to the Main routine, see FIG. 6. The MSVGSIO routine is an Interrupt Service routine to pass data to or from the data score board 44, see FIG. 2 and place it in a buffer register. The KTRANS routine will process that data, see FIG. 6D. The Piain routine passes 8-bits of data from the specified PIA to the microprocessor 100 of the PIAOUT passes 8-bits of data to the specified PIA. The Piain routine allows the VGS to communicate with the data score board 44, see FIG. 2, receiving video graphics data. The Piaout routine allow the MPU 48 to communicate video graphics commands to the GDC board 50 within the VGS, FIG. 2.

FIG. 7 illustrates the main loop of the Sysinit flowchart with the case function of the GDC Main expanded to show greater detail. The GDC Main routine consists of a character draw (CHARCTDRAW), area fill (AREAD FILL), line/vector draw, rectangular draw, palette select and page select routines. These routines issue video graphics commands to the GDC to display bowling game score information on the CRT. In accordance with FIG. 4, the video graphics database located within the EPROM/RAM 104 contains the bowling game score information currently being displayed on the CRT. The contents of the video graphics databasee is either a pixel-by-pixel representation of that information or draw commands of that information to the GDC 120, see FIG. 5.

FIG. 7A illustrates the character draw flowchart. The character draw command from the microprocessor 100, see FIG. 4, to the GDC 120, see FIG. 5, causes the GDC 120 to draw graphics characters into the video RAM 124 pixel-by-pixel, see FIG. 5. The graphics characters are found in the video graphics database which stores the bowling game score information currently on the screen. In the CLR BUFFR and CHAR BUF routines the microprocessor 100 clears the command and character buffer resistors. In the ZOOM routine, the microprocessor 100 generates a ZOOM video graphics command that initializes the ZOOM parameter, because this function is not used. In the SETCHAR routine the microprocessor 100 sets up the buffer register with a new pattern, an 8-by-8 character pattern in the parameter register, of bowling game score information. The microprocessor 100 then generates the PRM video graphics command which loads the 8-by-8 bit character pattern from the microprocessor 100 parameter register to the GDC 120 parameter register. In the WDAT routine the microprocessor 100 generates write data video graphics command which commands the GDC 120 to execute the read memory write cycle to write the 8-by-8 bit character in the GDC 120 parameter register into the video RAM 124 of the selected GDC. In the ADDRPLANE routine the microprocessor 100 calculates the base address of a color plane as a pointer to one of the four color planes that are stored in the video RAM 124. In the Figs routine, the microprocessor 100 generates a Figs video graphics command to the GDC 120 that the Figs command indicates to the GDC that the current graphics data is of the character form. In the Curs routine the microprocessor 100 generates the Curs video graphics command and passes within this command the video graphics address location on the CRT where the GDC 120 must display the character. In response to this Curs command, the GDC 120 will display the 8-by-8 bit character at that address location on the CRT display. At this point in the Character Draw routine the microprocessor 100 has loaded all the necessary commands and parameter into the GDC 120. In the GCHRD routine the microprocessor 100 generates the GCHRD video graphics command to the GDC 120. In response to the GCHRD video graphics command, the GDC 120 executes the previous sequence of previous commands received above. The execution of these commands will store the 8-by-8 bit character into the video graphics database and draw the character onto the CRT. The character draw routine executes the WDT, ADDRPLANE, FIGS, CURS and GCHRD routines for each color plane in video RAM.

Figure 7B:
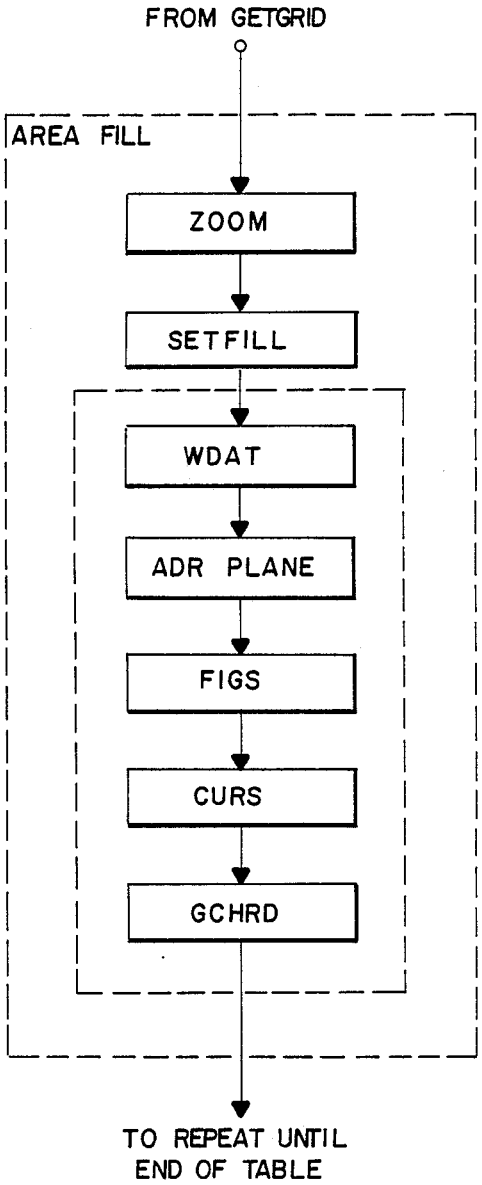

FIG. 7B illustrates Area Fill flowchart. The Area Fill command from the microprocessor 100, see FIG. 4, to the GDC 120, see FIG. 5, causes the GDC 120 to draw or clear to area in each of the four planes as required.

In the Zoom routine, the microprocessor 100 generates the Zoom video graphics command to initialize this function because it is not used. In the Setfill routine, the microprocessor 100 sets up a new 8-by-8 bit pattern bowling game score information into an internal buffer register then generates a PROM video graphics command which loads the 8-by-8 bit pattern from the microprocessor or 100 buffer registers to the GDC 120 parameter registers.

Similar to the Character Draw routine, the Area Fill routine executes the WDAT, ADRPLANE, FIGS, CURS and GCHRD routines for each color plane of the four color planes. In the WDAT routine the microprocessor 100 generates the WDAT video graphics command to the GDC 120. In response to this command, the GDC 120 executes the read-modify-write cycle to write the into the video RAM 124. In the ADDRPLANE routine, the microprocessor 100 calculates the base address of the color plane. In the Figs routine, the microprocessor generates the figs video graphics command to the GDC 120 which indicates that the current data is of character form, an 8-by-8 set of pixels. In the Curs routine, the microprocessor 100 generates the Curs video graphics command to the GDC 120 which passes as a parameter the video graphics ADDLESS location on the CRT where the GDC must display the character pattern. Again, in the GCHRD routine, the microprocessor generates the GCHRD video graphics command to the GDC 120 which commands the GDC 120 to execute the sequence of previous command to generate a character on the CRT.

Figure 7C:
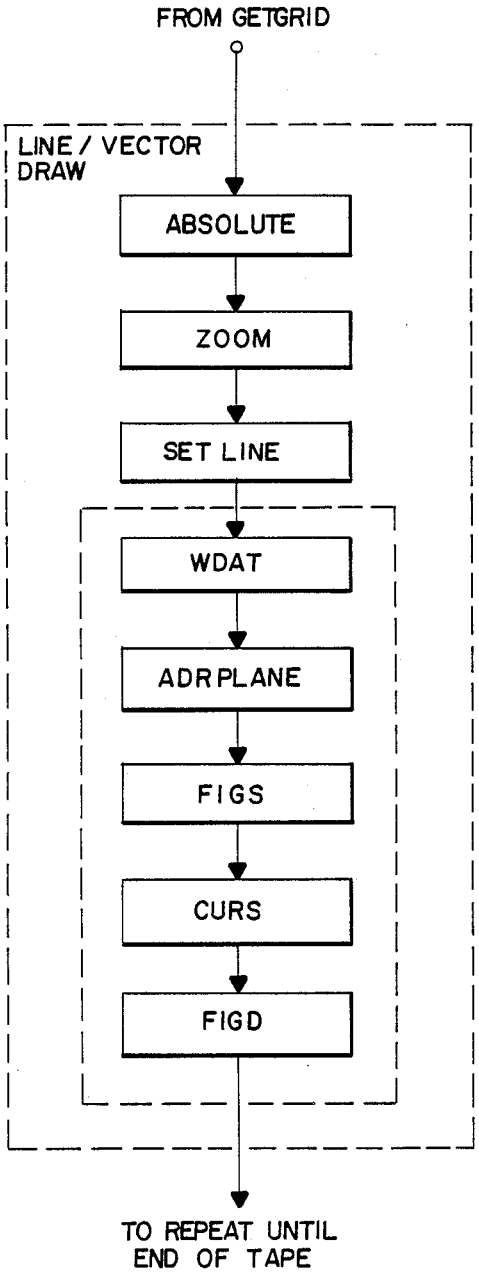

FIG. 7C illustrates the line/vector flowchart. The line/vector command from the microprocessor 100 to the GDC 120 causes GDC 120 to Draw a figure on the screen representing a line or a vector.

In the Absolute routine the microprocessor 100 calculates the Absolute value of an integer to provide positive lengths for lines or vector. In the Zoom routine the microprocessor again initializes the function since it is not used. In the Setline routine, the microprocessor 100 sets up an internal buffer register as a parameter register and stores the line type: including blank, solid, dotted or dashed in that parameter register. Then the microprocessor 100 generates the PRAM video graphics command which loads the microprocessor 100 parameter register to the GDC 120 parameter register. Similar to the character draw routine and the area fill routine, the WDAT, ADRPLANE, FIGS and CURS load the GDC 120 with all the keyboards and parameter necessary to draw a line or vector on the CRT. In the FIGD routine, the microprocessor 100 generates a FIGD video graphics command which commands the GDC 120 to executed the sequence of previous commands on the parameters and generate a figure on the CRT.

Figure 7D:
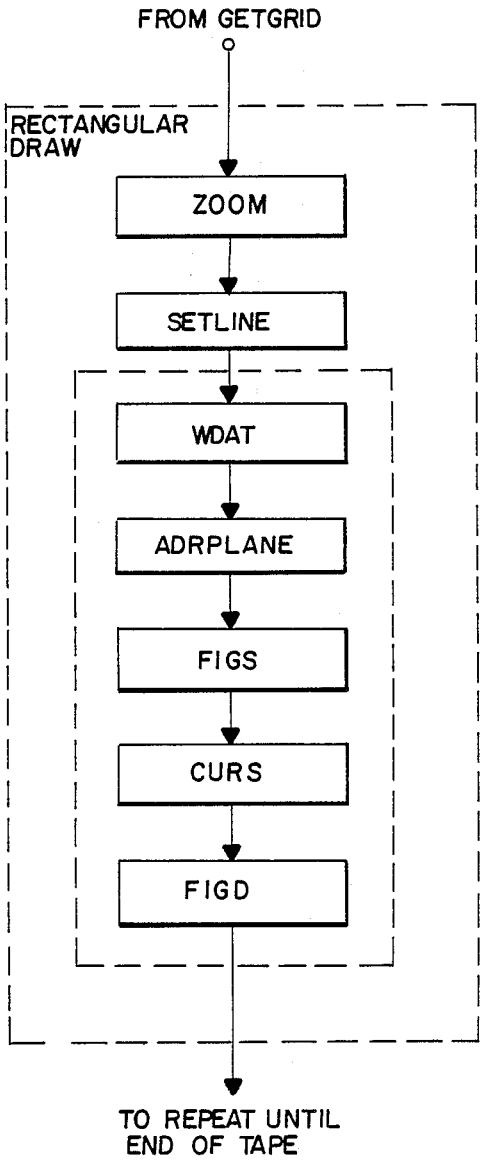

FIG. 7D illustrates the rectangular draw flowchart. Similar to the Character Draw, Area Fill and Line/-Vector Routines, in the Rectangular Draw routine, the microprocessor of video graphics commands to draw a rectangular figure on the CRT.

FIG. 8 illustrates a more detailed flowchart of the data transfer routine located in the Command Interpreter Routine. After the microprocessor 100 executes the MS-VGS 10 routine which accept video graphics data from the data score board 44, see FIG. 2, into the I/O port register in PIA 110, see FIG. 4, the Microprocessor 100 must transfer that video graphics data from the I/O port register at PIA 110, to internal buffer register of the Microprocessor 100. Execution of the Dxfer routine makes this database transfer.

In the Dtran routine, the microprocessor 100 transfer data from the I/O port on the PIA 110 to the internal buffer registers of the microprocessor 100. The microprocessor 100 then transfers that video graphics data to one of several tables in the video graphics data base in EPROM/RAM 104, see FIG. 4. Those table include: Top line of current CRT display, bowler one to bowler six areas, bottom line of current CRT display, or left or right bowler names with handicaps, blind averages, the name and team handicap. The microprocessor 100 must now process this video graphics data.

FIG. 8 illustrates the Update Left and Right Screen flowchart (Update). In the Update routine, the microprocessor 100 processes the video graphics data in any one of the following routines depending on which table the microprocessor 100 stored the video graphics data into.

Generally, the microprocessor 100 processes video graphics data as follows: First, the video graphics data is compared to the current video graphics database; second, if a change in the database occurred, then (1) the microprocessor 100 generates video graphics commands to the GDC 120 that clear the old information from the display with areafill call to GDC Main, see FIG. 7B; (2) the microprocessor 100 calls and executes the translate character routine which translate a character according to the grid format into an address pointer that references the appropriate set of video format characteristic; and (3) the microprocessor 100 generates video graphics commands to the GDC 120 to draw the translated character with the appropriate video format characteristic on the display; Third, if no change occurs then wait for the next video graphics data.

The microprocessor 100 processes video graphics data in this exact sequence in the flowing routines: Topline, Bowler 3, R seven T name, Hdcap and Subdisp.

In the Autoframe routine, the microprocessor 100 determines if the frame format was changed on the addition or deletion of 3 Bowler initials. If a change occurred, the Microprocessor 100 generates video graphics commands to rewrite the Grid and update the display information in the Bowler 3 routine explained in FIG. 8A and the GDC Main routine explained in FIG. 7.

In the Auto FMRL routine, the microprocessor 100 determines which five frames will be displayed based on the bowler with the most frames, if the five frame format is used.

In the Auto Grid routine, the microprocessor 100 determines if a new video display must be generated. If a new grid must be generated, then the microprocessor 100 blanks the display, generates video graphics commands that clear the RAM 124 of any video data, and generate video graphics commands that rewrite a new display. Bowler commands to clear the screen and start a new game is an example of this.

In the Topline routine, the microprocessor 100 generates video graphics commands that display Topline information on the CRT, such as messages from the front desk, or bowler team names. The microprocessor 100 updates the Left or Right Topline Alpha or numberic characters based on changes between the new video graphics data and the current database.

The Bowler 3 routine is explained in more detail in the explanation of FIG. 8A.

In the R seven routine, the microprocessor 100 updates the seventh row of the screen similar to the Topline routine.

In the T name routine, the microprocessor 100 generates video graphics command that display the team name and the Bowler names in the Tournament mode. The team name is generally centered across the top of the screen.

In the HDCAP routine, the microprocessor 100 generates video graphics commands that display the individual or team handicap based on the change between the new video graphics data and the current database.

In the Subdisp routine, the microprocessor 100 generates video graphics commands to display the intermediate scores for each frame.

FIG. 8A illustrates a more detailed flowchart of the Bowler 3 routine. The bowlers update routine checks for any changes between the video graphics data and the bowling game score information that display the bowling scores. If a change is found the microprocessor 100 generates video graphics commands to the GDC 120 to display the current video graphics data on the screen.

In the Set Index routine, the microprocessor 100 transforms a grid format into a table index so that the microprocessor 100 points to the appropriate grid format table in the video graphics database. The address pointer to the grid format table is a two dimension offset that accounts for character size select table and the data position table.

The pointer into the character size table points to one of four different sized characters depending on the number of bowlers. A separate character size gets assigned for one bowler per lane. The same character size gets assigned for 2, 3 or 4 bowlers per lane. A separate character size gets assigned for 5 bowlers per lane. And a separate bowler size gets assigned for 6 bowlers per lane.

A character size is stored in memory for each of the three grid formats; 10 frame, 5 frame, or tournament.

The video format characteristic of each character of bowling game score information consists of a set of characters from this grid format table. Examples of a set of video format characteristics include: 10 frame 6 bowlers, 10 frame 5 bowlers, 10 frame 2, 3, or 4 bowlers, 10 frame 1 bowler, or 5 frame 6 bowlers, 5 frame 5 bowlers, . . .

The video format characteristic may also include a set of characters in slanted type, script type, pica type, foreign language alphabets or numbers.

The pointer into the data position table points to the location of the character in the sequence of characters in any given set of video format characteristics.

In the GDC Main routine, the microprocessor 100 generates video graphic commands to clear the old character position.

In the Transch routine the microprocessor 100 translates the video graphics data into the appropriate character from the set of video format characteristics for this grid format.

In the GDC Main routine, the microprocessor 100 generates video graphics commands to draw this character on the CRT. And in the second GDC Main routine, the microprocessor 100 generates video graphics commands to display splits, e.g. 8/10 split, or corrections to the game score information.

In the subscore routine, the microprocessor 100 calculates bowler scores by fetching pinfall data from the video graphics database for the indicated bowler and calculating intermediate scores per bowling frame. The results are stored in an internal buffer register and displayed in the Subdisp routine.

In the Bandup routine, the microprocessor 100 removes the bandup color background of the previous bowler and places the bandup color background on the current bowler up. The bandup functions to highlight the current bowler score by using a different color background to contract that bowler score from all other bowlers.

The bandup character is stored in the set of video format characteristics for that particular grid format.

In the GDCREAD routine, the microprocessor 100 reads one line of 512 bits into an internal buffer register. The microprocessor generates a Curs video graphics command to the GDC 120 and passes within the command the video graphics address location on the CRT where the GDC 120 must read. In the Mask routine the microprocessor 100 generates a mask video graphics command that initializes this video graphics function. In the FIGS routine, the microprocessor 100 generates a FIGS video graphics command to the GDC 120. The FIGS command directs the GDC 120 to receive character data. In the RDAT routine the microprocessor 100 reads data from the display video RAM 124 from the GDC 120 and stores that data in an internal buffer register. To accomplish this the microprocessor 100 generates a RDAT video graphics command to the GDC 120. In response to this command the GDC 120 leads data from the video RAM 124 and stores it in an internal parameter register. Then the microprocessor 100 reads the status register of the GDC 120 and transfers the data from the parameter register when that data is available.

In the second GDC READ routine, the microprocessor reads data from the next line of 512 bits and stores these bits in a second internal buffer register. The microprocessor 100 executed the same sequence of video graphics commands.

In the GDC write, routing, the microprocessor 100 writes unbanded data to the screen which is the screen background color. In the ADDR PLANE routing, the microprocessor 100 calculates the base address of a color plane as a pointer to one of the four color planes that are stored in the video RAM 124.

In the Curs routine, the microprocessor 100 generates the Curs video graphics command to the GDC 120 and passes within the command the video graphics address location on the CRT where the GDC 120 must display the character.

In the FIGS routine, microprocessor 100 generates a FIGS video graphics command to the GDC 120 which indicates to the GDC 120 that the graphics data will be of character type.

In the MASK routine, the microprocessor 100 generates a mask video graphics command to initialize the mask function.

In the WDAT Routine, the microprocessor 100 generates a WDAT video graphics command which commands the GDC 120 to executed the read-memory-write cycle to write the contents of the GDC 120 parameter register into the video RAM 124.

In the Follow Bandup routine, the microprocessor 100 displays the bandup characteristic for the current bowler. The microprocessor 100 executes the same sequence of video graphics commands as when it removed the bandup characteristic from the previous bowler.

FIG. 9 illustrates a more detailed flowchart of the Format Select routine located within the Command Int routine, see FIG. 6D. In this routine the microprocessor 100 selects a grid format for the left or right channel. The grid formats include the 5 frame, 10 frame, or tournament formats.

Each grid format is stored in the EPROM/RAM 104 and includes a set of video format characteristics. The set of video format characteristics for a particular grid format consists of any video data that may be displayed in that grid format. That video data includes numerics, alphacharacters of lower and upper case, a grid format background. As previously explained it may include: slanted type, script type, pica type and foreign characters.

For any given grid format for a fixed number of bowlers, the VGS assigns a set of video format characters that result in different size alpha/numeric characters and a different size grid format. The size of the characters and grid format increase as the number of bowlers playing decreases. This maximizes the bowlers ability to read the bowling score information on the screen. In addition, this feature will speed up bowling play because less time will be wasted examining the screen to interpret bowling scores.

In the L10 frame routing the microprocessor 100 assigns the 10 frame format to the left CRT.

In the R10 frame routine the microprocessor 100 assigns the 10 frame format to the right CRT.

In the L5 frame routine the microprocessor 100 assigns the 5 frame format to the left CRT.

In the R5 frame routine the microprocessor assigns the 5 frame format to the right CRT.

In the L Tourney routine the microprocessor 100 assigns the tournament format to the left CRT.

In the R Tourney routine the microprocessor 100 assigns the tournament format to the right CRT.

FIGS. 10–16 illustrate some of the different scoring display format characteristics that may be selected in accordance with this invention. FIG. 10 shows the display for a conventional bowling league team comprised of six members. Bowler's names (actually initials) appear in the left column and the respective frame scores are displayed in horizontal bands in which the initials appear. Handicaps appear in the last column, and total team score and team handicap appear at the bottoms of the last two columns.

Compare the size of the grid blocks and alphanumeric characters of FIG. 10 with those of FIG. 11 which has a grid to display only the last five frames and handicaps for only five bowlers. It is seen that in FIG. 11 the dimensions of the grid and characters are proportioned to fill the same area of the CRT face as in FIG. 10, and therefore are larger than in FIG. 10.

FIG. 12 illustrates a display format similar to FIG. 11 except that only three bowlers are shown. Again the sizes of the grid and characters are proportional to fill the same area of the CRT screen as in FIG. 10 and 11.

FIG. 13 illustrates the completed scorecard of all the ten frames, handicaps and totals for four bowlers. The grid and characters are proportioned to fill the same area of the CRT face as in the previous format examples.

FIG. 14 shows a display format on the same area of the CRT screen characterized by a six bowler score grid and the five most recent frames. It will be noted that the "up" bowler is Betty Hobbs (BH), and an arrow by her initials indicates that she is up. The frame numbers show that Betty Hobbs is bowling her seventh frame. Note the grid and character dimensions are smaller than in FIG. 12, for example.

FIG. 15 is yet another example showing the versatility and selectability afforded by the present invention. Here, just a single bowler's grid band, frame, and score characters are displayed in the largest dimensions yet illustrated. As example, the name of a tournament is shown at the top of the display and the bowler's name and number are shown above the grid.

FIG. 16 shows a ten frame grid format for a pair of bowlers, as might be used in a head-to-head match. The display is presented on the same area of the CRT face as the previous examples and the grid and character format are proportioned to fit within that area.

As previously stated and explained, the video graphics command signals for the different grids and characters are stored and the video format command signals put in at the manager's or bowler's keyboard causes the selected formats to be retrieved from memory and displayed as the game progresses. Alternative means might be employed wherein the video format commands ultimately control one or more grid and character generators and directly generate the necessary video graphic commands to actively produce the desired format characteristic in the display. In other words, the video format commands would not be stored, but would be actively generated as needed for the display selected.

We claim:

1. In a bowling scoring system that displays game score information for a game of bowling on a display means in one of a plurality of selectable bowling score display formats on which one or more bowlers' names and/or scores are entered, the combination comprising means for producing command signals including selectable video format commands, wherein said selectable video format commands include a plurality of different selectable format characteristics for displaying a score card grid pattern having a plurality of horizontal bands for containing alphanumeric characters representing one of more bowlers' names and/or bowling scoring information relating to said one or more bowlers, and wherein said selectable video format commands determine the dimensions of the horizontal bands and said alpha-numeric characters contained therein means for producing bowler name graphic signals representing one or more bowlers' names, means for producing pinfall count signals corresponding to bowling pins knocked down by a bowler, means for coupling said command signals, said bowler name graphic signals, and said pinfall count signals to a microprocessor means, said microprocessor means receiving said signals coupled thereto and processing them to produce video graphics signals that include selectable video format information and bowling game score information, means for receiving said video graphics signals and for selectively producing video format characteristic signals corresponding to one or more of a plurality of video format characteristics associated with a selected one or more of said video format commands, and means including display means responsive to said video format characteristic signals, said bowler name graphic signals and said game score information for displaying bowling game score information for said one or more bowlers in a selected one of said video formats.

2. The combination claimed in claim 1 wherein said means for producing video signal format characteristic signals operates in response to video graphic signals corresponding to selected video format commands to produce signals that cause the display means to produce a display of game score information having characters of sizes that are selected from a plurality of different sizes.

3. The combination claimed in claim 1 wherein said video graphic signals include game score grid information corresponding to the grid of a bowling score sheet, and wherein said selectable video format commands include commands to cause the means for producing video format characteristic signals to produce a display that includes at least a portion of a bowling score sheet grid.

4. The combination claimed in claim 1, wherein said display means includes a color cathode ray tube, and wherein, said means for producing video graphic signals and the means for producing video format characteristic signals includes means for selecting a first color for a background of a cathode ray tube display of game score information, a second color for the displayed characters of the game score information, and a third color for a horizontal band across the face of the CRT, wherein the band includes a selected bowler name and his selected game score information.

5. The combination claimed in claim 1 wherein said video format includes at least a portion of a score sheet grid displayed on said display means, and further including means for entering bowler's names or initials on said displayed scoresheet grid, means in said system for sensing the number of entered bowler's names or initials, and means responsive to said sensing means for proportioning the size and shape of said displayed grid, said names or initials, and bowling game score information to fill a given area of display means with said display of names and game score information irrespective of which video format characteristic and which portion of the scoresheet grid is selected for display.

6. The combination claimed in claim 1 wherein said means for producing video format characteristic signals and said means including the display means cause the display of game score information on the display means to occupy substantially the same area of the display means irrespective of which one of the display formats is selected.

7. The combination claimed in claim 1 wherein said means for producing video format characteristic signals operates in response to video graphic signals corresponding to selected video format commands to display less than all the available game score information and only the most recently generated game score information for said one or more players whose scores are displayed on said display means.

8. A method of selectively displaying on a display means bowling scores in a selected one of a plurality of bowling game scoring formats on which one or more bowlers' names and/or scores are entered, comprising the steps of:

producing data and command signals including a selected one or more of a plurality of selectable video format commands that includes a plurality of different selectable format characteristics for displaying a scorecard grid pattern having a plurality of horizontal bands for containing alpha-numeric characters representing one or more bowlers' names and/or bowling scoring information, and wherein said selectable video format commands determine the dimensions of the horizontal bands and the alpha-numeric characteristics contained therein, coupling said data and command signals to a microprocessor means, producing pinfall count signals corresponding to bowling pins knocked down by a bowler, receiving bowling pinfall count signals and coupling them to said microprocessor means, processing said data, command and pinfall count signals to produce video graphics signals that include selected video format information and bowling game score information, producing corresponding video format characteristic signals in response to said selected video format commands, and displaying bowling game score information for said bowlers in the selected video format produced by said video format characteristic signals.

9. The method claimed in claim 8 including the steps displaying less than all the game score information that is available for display and only the more recently generated games score information for said one or more players whose scores are to be displayed, and displaying only a portion of a game scorecard grid that accommodates said displayed game score that is less than all that is available.

10. The method claimed in claim 8 and including the steps producing as part of said data signals bowler name signals that designate how each bowler's game scores are to be displayed, producing in response to said bowler name signals selected video format characteristic signals that produce a video format that will accommodate only the number of bowlers that corresponds to the bowlers represented by the bowler name signals.

11. In a bowling system that displays game score information for a game of bowling on a display means in one of a plurality of selectable bowling score display formats on which one or more bowler's names and/or scores are entered, the combination comprising, means for producing bowler name signals designating each bowler whose games scores are to be displayed, means for producing command signals including selectable video format commands, wherein said selectable video format commands include a plurality of different selectable display format characteristics for displaying a scorecard grid pattern having a plurality of horizontal bands for containing alphanumeric characters representing one or more bowler's names and/or bowling scoring information relating to said one or more bowlers and wherein said selectable video format commands determine the dimensions of the horizontal bands and said alpha-numeric characteristics contained therein, means for producing pinfall count signals corresponding to bowling pins knocked down by a bowler, means for receiving said command signals, said bowler's name signals, and said pinfall count signals and coupling them to microprocessor means, said microprocessor means processing said signals coupled thereto to produce video graphic signals that include selectable video format information and bowling game score information, means for receiving said video graphics signals and for selectively producing video format characteristic signals corresponding to said video format commands, and means including video display means responsive to said video format characteristic signals and said game score video graphic signals for displaying bowling game score information for said one or more bowlers in the selected video format characteristic.

12. The combination claimed in claim 11 including means responsive to the means for producing bowler name signals for automatically selecting a bowling scoring video format characteristic that will accommodate the bowling scores only for the number of bowlers that corresponds to the bowlers represented by the bowler name signals.

13. The combination claimed in claim 11 wherein said means for producing video format characteristic signals operates in response to video graphic signals corresponding to selected video format commands to display less than all the available game score information and only the more recently generated game score information for said one or more players whose scores are displayed on said display means.

* * * * *

UNITED STATES PATENT AND TRADEMARK OFFICE

CERTIFICATE OF CORRECTION

PATENT NO. : B1-4,887,813

DATED : December 1, 1992

INVENTOR(S) : CHILES, III et al.

It is certified that error appears in the above-identified patent and that said Letters Patent is hereby corrected as shown below:

ON THE TITLE PAGE

Please delete the assignee in its entirety and replace it with the following:

--[73] Assignee: AMF Bowling Companies, Inc.--

Signed and Sealed this

Twelfth Day of October, 1993

*Attest:*

Bruce Lehman

BRUCE LEHMAN

*Attesting Officer*

*Commissioner of Patents and Trademarks*

US004887813B1

REEXAMINATION CERTIFICATE (1864th)

United States Patent [19]

[11] B1 4,887,813

Chiles, III et al.

[45] Certificate Issued Dec. 1, 1992

[54] BOWLING SCORING DISPLAY SYSTEM

[75] Inventors: Robert E. Chiles, III, Sterling; Bruce R. Neville, Centreville, both of Va.; Richard D. Wattis, Potomac, Md.; Scott Werthmann, Cos Cob, Conn.

[73] Assignee: AMP Bowling Companies Inc.

Reexamination Request:
No. 90/002,444, Sep. 20, 1991

Reexamination Certificate for:

| | |
|---|---|
| Patent No.: | **4,887,813** |
| Issued: | **Dec. 19, 1989** |
| Appl. No.: | **155,658** |
| Filed: | **Jan. 21, 1988** |

Related U.S. Application Data

[63] Continuation of Ser. No. 918,686, Oct. 14, 1986, which is a continuation of Ser. No. 678,304, Dec. 5, 1984, abandoned.

[51] Int. Cl.[5] ..... A63D 5/04

[52] U.S. Cl. ..... 273/54 C; 273/DIG. 26; 340/731

[58] Field of Search .... 273/54 C, DIG. 28, DIG. 26; 340/731, 323 B; 364/411

[56] References Cited

U.S. PATENT DOCUMENTS

| | | |
|---|---|---|
| 4,225,924 | 9/1980 | Trujillo . |
| 4,367,876 | 1/1983 | Kotoyori . |
| 4,574,279 | 3/1986 | Roberts . |
| 4,654,651 | 3/1987 | Kishi et al. . |
| 4,760,527 | 7/1988 | Sidley . |

OTHER PUBLICATIONS

Brunswick AS-80 Automatic Scorer Operation Manual, No. 57-900202 dated Dec. 1982.

*Primary Examiner*—Jessica J. Harrison

[57] ABSTRACT

A bowling scoring display in which the score of a bowling game may be displayed in a selected one of a plurality of different display formats. As example, the number of bowlers whose scores are displayed may be changed, and the number of frames of a bowling game that are displayed may be changed. As a general rule, the fewer the number of players and/or frames that are displayed, the larger the alpha-numeric characters used in the display.

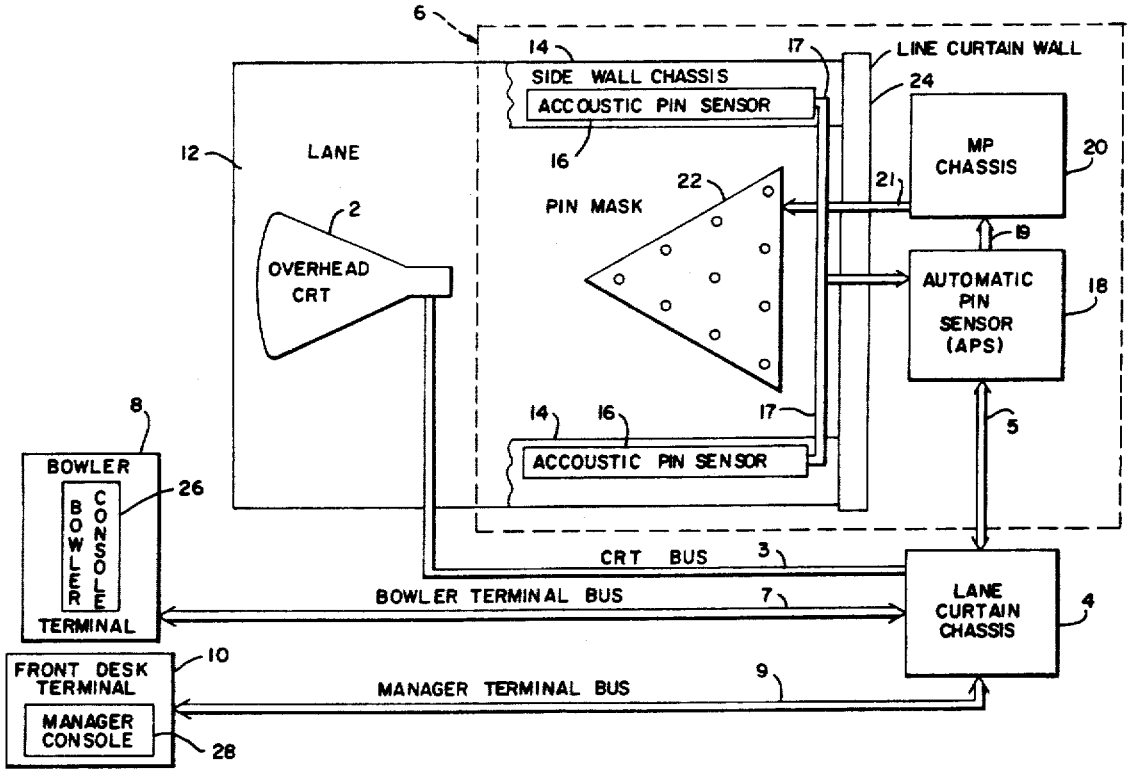

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-3 and 8-11 are cancelled.

Claims 4-7, 12 and 13 are determined to be patentable as amended.

4. The combination claimed in claim [1] *5*, wherein said display means includes a color cathode ray tube, and wherein, said means for producing video graphic signals and the means for producing video format characteristic signals includes means for selecting a first color for a background of a cathode ray tube display of game score information, a second color for the displayed characters of the game score information, and a third color for a horizontal band across the face of the CRT, wherein the band includes a selected bowler name and his selected game score information.

5. [The combination claimed in claim 1 wherein] *In a bowling scoring system that displays game score information for a game of bowling on a display means in one of a plurality of selectable bowling score display formats on which one or more bowlers' names and/or scores are entered, the combination comprising*

*means for producing command signals including selectable video format commands, wherein said selectable video format commands include a plurality of different selectable format characteristics for displaying a score card grid pattern having a plurality of horizontal bands for containing alpha-numeric characters representing one or more bowlers' names and/or bowling scoring information relating to said one or more bowlers, and wherein said selectable video format commands determine the dimensions of the horizontal bands and said alpha-numeric characters contained therein*

*means for producing bowler name graphic signals representing one or more bowlers' names,*

*means for producing pinfall count signals corresponding to bowling pins knocked down by a bowler,*

*microprocessor means and means for coupling said command signals, said bowler name graphic signals, and said pinfall count signals to said microprocessor means,*

*said microprocessor means receiving said signals coupled thereto and processing them to produce video graphics signals that include selectable video format information and bowling game score information,*

*means for receiving said video graphics signals and for selectively producing video format characteristic signals corresponding to one or more of a plurality of video format characteristics associated with a selected one or more of said video format commands,*

*means including display means of a given area responsive to said video format characteristic signals, said bowler name graphic signals and said game score information for displaying bowling game score information for said one or more bowlers in a selected one of said video formats,* said video format [includes] *including* at least a portion of a score sheet grid displayed on said display means, and further including means for entering bowler's] *bowlers'* names or initials on said displayed scoresheet grid, means in said system for sensing the number of entered [bowler's] *bowlers'* names or initials, and means responsive to said sensing means for *automatically* proportioning the size and shape of said displayed grid, said names or initials, and bowling game score information to fill [a given area of display means] *the entire display area* with said display of names and game score information irrespective of which vide format characteristic and which portion of the scoresheet grid is selected for display.

6. The combination claimed in claim [1] *5* wherein said means for producing video format characteristic signals and said means including the display means cause the display of game score information on the display means to occupy substantially the same area of the display means irrespective of which one of the display formats is selected.

7. The combination claimed in claim [1] *5* wherein said means for producing video format characteristic signals operates in response to video graphic signals corresponding to selected video format commands to display less than all the available game score information and only the most recently generated game score information for said one or more players whose scores are displayed on said display means.

12. [The combination claimed in claim 11 including] *In a bowling system that displays game score information for a game of bowling on a display means in one of a plurality of selectable bowling score display formats on which one or more bowlers' names and/or scores are entered, the combination comprising,*

*means for producing bowler name signals designating each bowler whose game scores are to be displayed,*

*means for producing command signals including selectable video format commands, wherein said selectable video format commands include a plurality of different selectable display format characteristics for displaying a scorecard grid pattern having a plurality of horizontal bands for containing alpha-numeric characters representing one or more bowler's names and/or bowling scoring information relating to said one or more bowlers and wherein said selectable video format commands determine the dimensions of the horizontal bands and said alpha-numeric characteristics contained therein,*

*means for producing pinfall count signals corresponding to bowling pins knocked down by a bowler,*

*microprocessor means and means for receiving said command signals, said bowlers' name signals, and said pinfall count signals and coupling them to said microprocessor means,*

*said microprocessor means processing said signals coupled thereto to produce video graphic signals that*

*include selectable video format information and bowling game score information,*

*means for receiving said video graphics signals and for selectively producing video format characteristic signals corresponding to said video format commands,*

*means including video display means responsive to said video format characteristic signals and said game score video graphic signals for displaying bowling game score information for said one or more bowlers in the selected video format characteristic, and* means responsive to the means for producing bowler name signals for automatically [selecting a bowling scoring video format characteristic that] *adjusting the size and shape of the characters representing the bowlers' names or initials and scores so that the entire area of said display means* will accommodate the *names, initials and* bowling scores only for the number of bowlers that corresponds to the bowlers represented by the bowler name signals.

13. The combination claimed in claim [11] *12* wherein said means for producing video format characteristic signals operates in response to video graphic signals corresponding to selected video format commands to display less than all the available game score information and only the more recently generated game score information for said one or more players whose scores are displayed on said display means.

* * * * *